US010283248B2

(12) United States Patent
Takeda

(10) Patent No.: US 10,283,248 B2
(45) Date of Patent: May 7, 2019

(54) ELECTRONIC COMPONENT

(71) Applicant: MURATA MANUFACTURING CO., LTD., Kyoto-fu (JP)

(72) Inventor: Yasushi Takeda, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 337 days.

(21) Appl. No.: 15/248,666

(22) Filed: Aug. 26, 2016

(65) Prior Publication Data

US 2017/0069417 A1 Mar. 9, 2017

(30) Foreign Application Priority Data

Sep. 4, 2015 (JP) ..... 2015-174679

(51) Int. Cl.

| | |
|---|---|
| ***H01F 5/00*** | (2006.01) |
| ***H01F 27/28*** | (2006.01) |
| ***H01F 17/00*** | (2006.01) |
| *H01F 41/04* | (2006.01) |

(52) U.S. Cl.

CPC ..... *H01F 17/0013* (2013.01); *H01F 41/043* (2013.01); *H01F 2017/004* (2013.01); *H01F 2017/0073* (2013.01)

(58) Field of Classification Search

CPC ..... H01F 2017/004

USPC ..... 336/200, 223, 232

See application file for complete search history.

(56) References Cited

U.S. PATENT DOCUMENTS 4,543,553 A * 9/1985 Mandai ..... H01F 17/0013 29/602.1
4,689,594 A * 8/1987 Kawabata ..... H01F 41/02 336/200
5,977,850 A * 11/1999 Chaturvedi ..... H01P 3/088 333/162

(Continued)

FOREIGN PATENT DOCUMENTS

JP H02-172207 A 7/1990
JP H08-078266 A 3/1996

(Continued)

OTHER PUBLICATIONS

An Office Action issued by the Japanese Patent Office dated Sep. 25, 2018, which corresponds to Japanese Patent Application No. 2015-174679 and is related to U.S. Appl. No. 15/248,666; with English translation.

(Continued)

*Primary Examiner* — Ronald Hinson

(74) *Attorney, Agent, or Firm* — Studebaker & Brackett PC

(57) ABSTRACT

An electronic component including, a first side, a second side, a third side, and a fourth side connected in that order in a predetermined direction so as to demarcate a tetragonal track. A first coil conductor layer lies astride the first side and the second side. A second coil conductor layer lies astride the second side and the third side and is connected to the first coil conductor layer on the second side. A third coil conductor layer lies astride the third side and the fourth side and is connected to the second coil conductor layer on the third side. At least one of the first coil conductor layer and the third coil conductor layer is not disposed at a first corner formed by the first side and the fourth side, when viewed from the stacking direction.

6 Claims, 22 Drawing Sheets

(56) References Cited

U.S. PATENT DOCUMENTS

| | | | | |
|---|---|---|---|---|
| 6,189,200 | B1 * | 2/2001 | Takeuchi | H01F 17/0013 156/89.12 |
| 6,692,609 | B2 * | 2/2004 | Kobayashi | H01F 17/0013 156/272.8 |
| 7,652,554 | B2 * | 1/2010 | Moriai | H01C 7/1006 338/61 |
| 9,966,183 | B2 * | 5/2018 | Yamauchi | H01F 27/2804 |
| 2013/0147593 | A1 * | 6/2013 | Tachibana | H01F 17/0013 336/200 |

FOREIGN PATENT DOCUMENTS

| | | | |
|---|---|---|---|
| JP | 2001-244117 | A | 9/2001 |
| JP | 2002-141225 | A | 5/2002 |
| JP | 2010-183007 | A | 8/2010 |

OTHER PUBLICATIONS

An Office Action; "Notification of Reasons for Rejection," issued by the Japanese Patent Office dated May 8, 2018, which corresponds to Japanese Patent Application No. 2015-174679 and is related to U.S. Appl. No. 15/248,666.

Notification of the First Office Action issued by the State Intellectual Property Office of the People's Republic of China dated Nov. 24, 2017, which corresponds to Chinese Patent Application No. 201610791706.3 and is related to U.S. Appl. No. 15/248,666.

* cited by examiner

ELECTRONIC COMPONENT

CROSS REFERENCE TO RELATED APPLICATIONS

This application claims benefit of priority to Japanese Patent Application 2015-174679 filed Sep. 4, 2015, the entire content of which is incorporated herein by reference.

TECHNICAL FIELD

The present disclosure relates to an electronic component including a coil.

BACKGROUND

To date, a multilayer electronic component described in, for example, Japanese Unexamined Patent Application Publication No. 2010-183007 is known as an electronic component. FIG. 20 is an exploded perspective view of a multilayer body 100 of the multilayer electronic component described in Japanese Unexamined Patent Application Publication No. 2010-183007.

As shown in FIG. 20, the multilayer electronic component includes a multilayer body 100 and inner conductor layers 102*a* to 102*d*. In this regard, inner conductor layers other than the inner conductor layers 102*a* to 102*d* are included in the multilayer body 100. However, only the inner conductor layers necessary for explanation are provided with reference numerals. The multilayer body 100 has a configuration in which multilayer body sheets 104*a* to 104*l* are stacked in that order from top to bottom.

The inner conductor layers 102*a* to 102*d* are disposed in the multilayer body sheets 104*d* to 104*g*, respectively, and have the shape of substantially the letter L. Specifically, the inner conductor layers 102*a* to 102*d* overlap each other so as to form a substantially rectangular track, when viewed from above. The inner conductor layer 102*a* overlaps with a right short side and a rear long side of the track. The inner conductor layer 102*b* overlaps a rear long side and a left short side of the track. The inner conductor layer 102*c* overlaps a left short side and a front long side of the track. The inner conductor layer 102*d* overlaps a front long side and a right short side of the track. The inner conductor layers 102*a* to 102*d* penetrate the multilayer body sheets 104*d* to 104*g*, respectively, in the vertical direction. Therefore, the inner conductor layer 102*a* is connected to the inner conductor layer 102*b* on the rear long side. The inner conductor layer 102*b* is connected to the inner conductor layer 102*c* on the left short side. The inner conductor layer 102*c* is connected to the inner conductor layer 102*d* on the front long side. Consequently, a spiral coil is formed.

The multilayer electronic component described in Japanese Unexamined Patent Application Publication No. 2010-183007 has a problem that short-circuit of the coil occurs easily. Specifically, for example, the right short side of the inner conductor layer 102*a* is opposite to the right short side of the inner conductor layer 102*d*. However, there are two insulator layers 104*e* and 104*f* between the two short sides. Consequently, the probability of occurrence of short-circuit between the right short side of the inner conductor layer 102*a* and the right short side of the inner conductor layer 102*d* is relatively low.

On the other hand, the end portion on the upstream side in the counterclockwise direction of the inner conductor layer 102*a* is opposite to the end portion on the downstream side in the counterclockwise direction of the inner conductor layer 102*c*. There is only one insulator layer 104*e* between these two end portions. Consequently, the probability of occurrence of short-circuit between the end portion on the upstream side in the counterclockwise direction of the inner conductor layer 102*a* and the end portion on the downstream side in the counterclockwise direction of the inner conductor layer 102*c* is relatively high. Therefore, the multilayer electronic component described in Japanese Unexamined Patent Application Publication No. 2010-183007 has a possibility of occurrence of short-circuit in the coil at specific locations.

SUMMARY

Accordingly, it is an object of the present disclosure to provide an electronic component, in which an occurrence of short circuit in a coil can be suppressed.

According to preferred embodiments of the present disclosure, an electronic component includes a multilayer body having a configuration, in which a plurality of insulator layers are stacked in the stacking direction, and a coil, which is disposed in the multilayer body and which includes a first coil conductor layer, a second coil conductor layer, and a third coil conductor layer arranged in that order from one side of the stacking direction toward the other side, wherein a first side, a second side, a third side, and a fourth side are connected in that order in a predetermined direction so as to demarcate a tetragonal track, when viewed from the stacking direction, the first coil conductor layer lies astride the first side and the second side, the second coil conductor layer lies astride the second side and the third side and is connected to the first coil conductor layer on the second side, the third coil conductor layer lies astride the third side and the fourth side and is connected to the second coil conductor layer on the third side, and at least one of the first coil conductor layer and the third coil conductor layer is not disposed at a first corner formed by the first side and the fourth side, when viewed from the stacking direction.

According to preferred embodiments of the present disclosure, an electronic component includes a multilayer body having a configuration, in which a plurality of insulator layers are stacked in the stacking direction, and a coil, which is disposed in the multilayer body and which includes a first coil conductor layer, a second coil conductor layer, a third coil conductor layer, and a fourth coil conductor layer arranged in that order from one side of the stacking direction toward the other side, wherein a first side, a second side, a third side, and a fourth side are connected in that order in a predetermined direction so as to demarcate a tetragonal track, when viewed from the stacking direction, the first coil conductor layer and the second coil conductor layer lie astride the first side and the second side and are connected to each other on the first side and the second side, the third coil conductor layer lies astride the second side and the third side and is connected to the second coil conductor layer on the second side, the fourth coil conductor layer lies astride the third side and the fourth side and is connected to the third coil conductor layer on the third side, and at least one of the second coil conductor layer and the fourth coil conductor layer is not disposed at a first corner formed by the first side and the fourth side, when viewed from the stacking direction.

Other features, elements, characteristics and advantages of the present disclosure will become more apparent from the following detailed description of preferred embodiments of the present disclosure with reference to the attached drawings.

DETAILED DESCRIPTION

Configuration of Electronic Component

Figure 1:
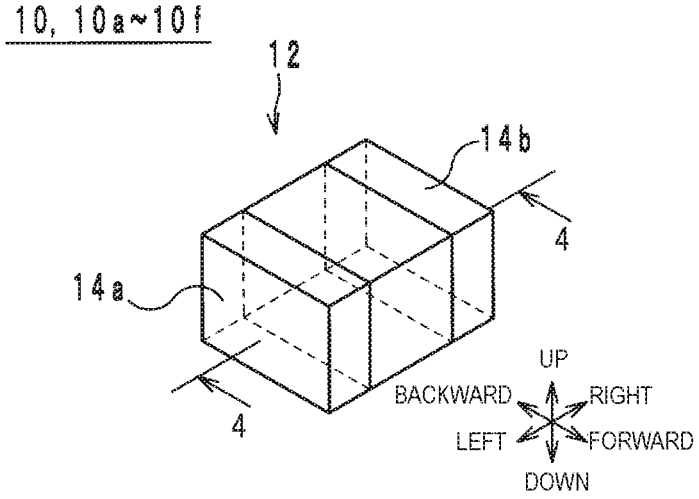
FIG. 1 is an outside perspective view of each of electronic components.
Figure 2:
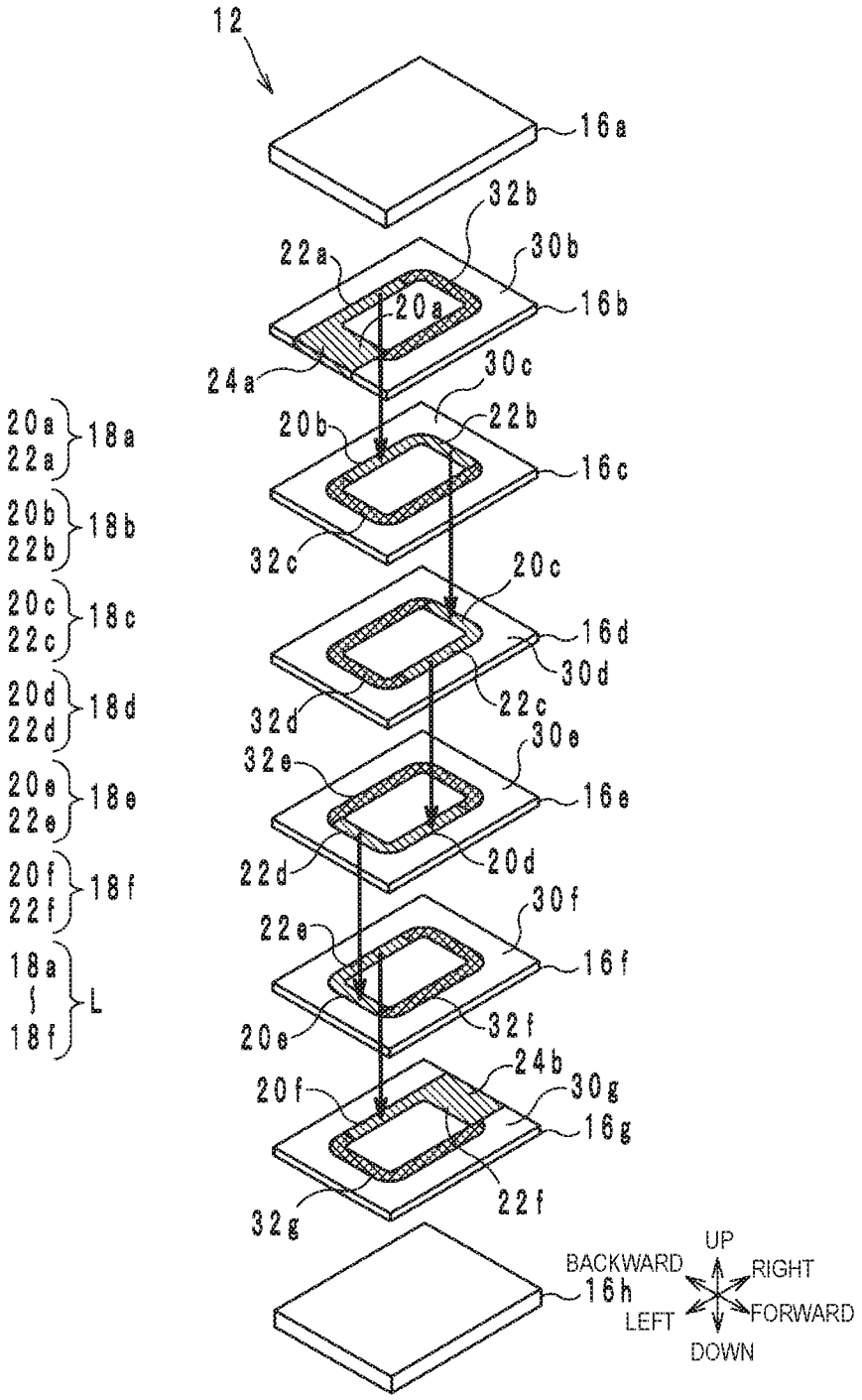
FIG. 2 is an exploded perspective view of a multilayer body of the electronic component.
Figure 3A:
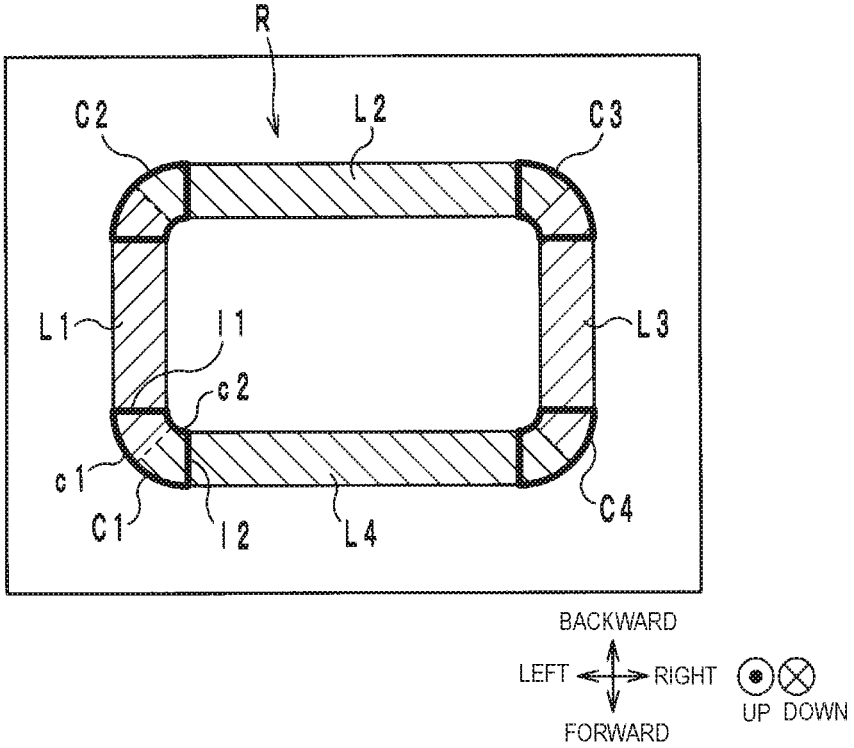
FIG. 3A is a diagram of a track, viewed from above.
Figure 3B:
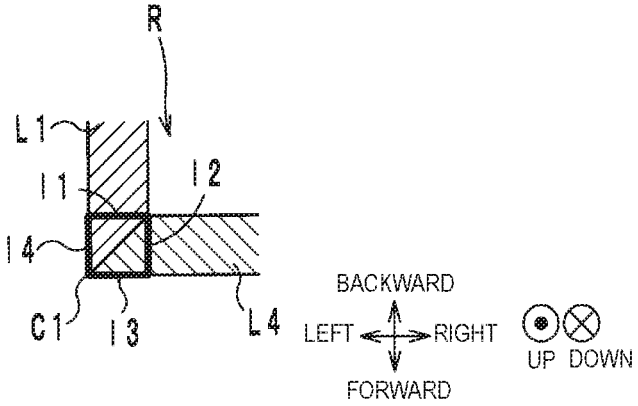
FIG. 3B is a diagram of part of a track according to another example, viewed from above.
Figure 4A:
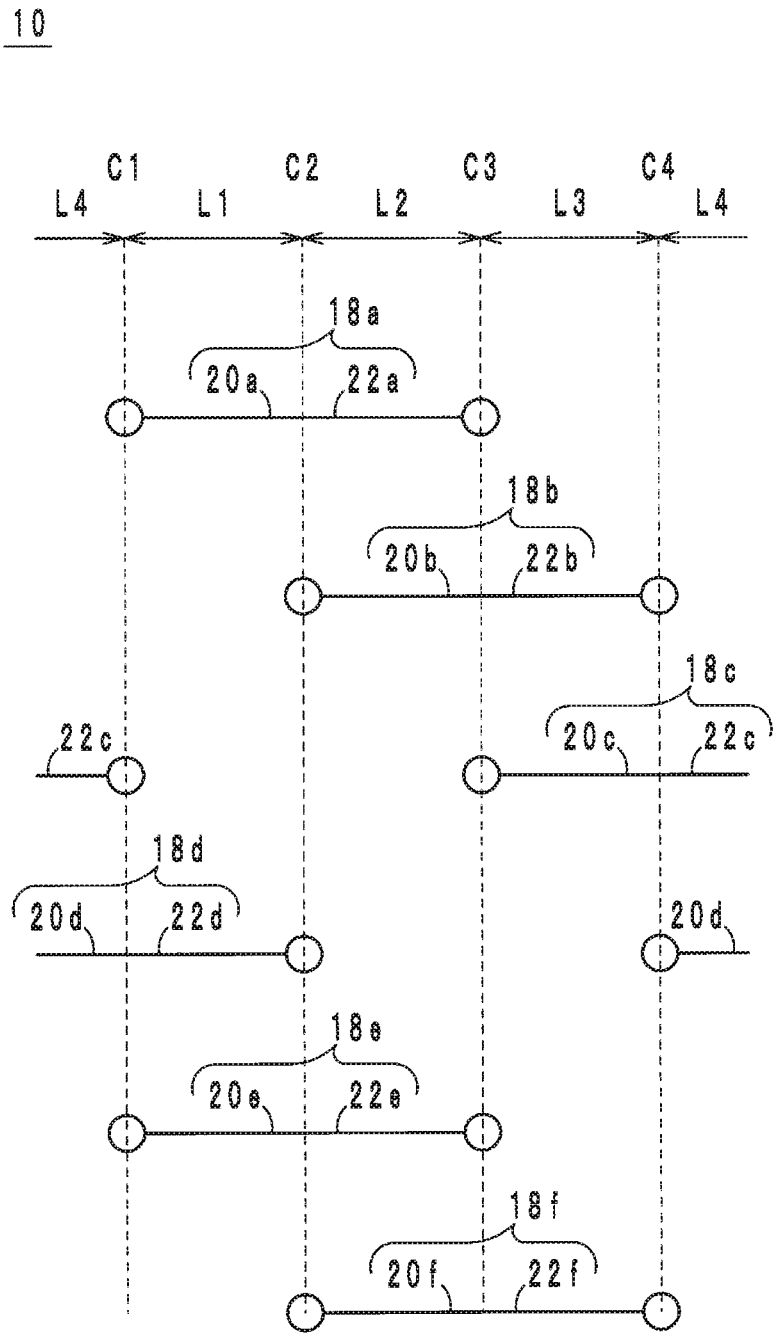
FIG. 4A is a diagram showing the positional relationship between coil conductor layers in the electronic component.
Figure 4B:
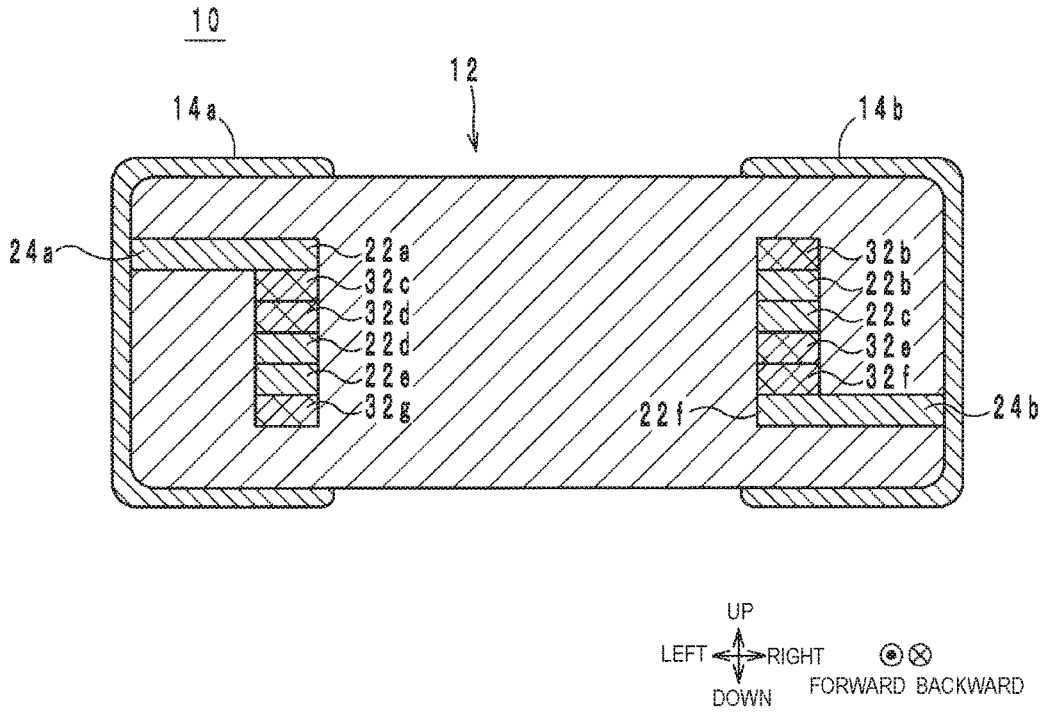
FIG. 4B is a structural sectional view of the electronic component, along a line 4-4 shown in FIG. 1.

The configuration of an electronic component according to an embodiment of the present disclosure will be described below with reference to the drawings. FIG. 1 is an outside perspective view of each of electronic components 10 and 10*a* to 10*f*. FIG. 2 is an exploded perspective view of a multilayer body 12 of the electronic component 10. FIG. 3A is a diagram of a track R, viewed from above. FIG. 3B is a diagram of part of a track R according to another example, viewed from above. FIG. 4A is a diagram showing the positional relationship between coil conductor layers 18*a* to 18*f* in the electronic component 10. FIG. 4B is a structural sectional view of the electronic component 10*a*, along a line 4-4 shown in FIG. 1.

Hereafter the stacking direction of the electronic component 10 is defined as the vertical direction (the upper side is an example of one side of the stacking direction and the lower side is an example of the other side of the stacking direction). When the electronic component 10 is viewed from above, the direction of extension of the long side of the electronic component 10 is defined as the lateral direction, and the direction of extension of the short side of the electronic component 10 is defined as the forward or backward direction. The vertical direction, the forward or backward direction, and the lateral direction are orthogonal to each other.

As shown in FIG. 1 and FIG. 2, the electronic component includes the multilayer body 12, outer electrodes 14*a* and 14*b*, lead conductor layers 24*a* and 24*b*, and a coil L. As shown in FIG. 2, the multilayer body 12 has a substantially rectangular parallelepiped shape and has a configuration in which insulator layers 16*a* to 16*h* are stacked so as to be arranged in that order from top to bottom.

The insulator layers 16*a* to 16*h* are produced from ferrite having magnetism (for example, Ni—Zn—Cu ferrite, Ni—Zn ferrite, or the like) and are substantially rectangular insulator layers, when viewed from above. The insulator layers 16*b* to 16*g* include magnetic portions 30*b* to 30*g*, respectively, and nonmagnetic portions 32*b* to 32*g*, respectively. The magnetic portions 30*b* to 30*g* are produced from ferrite having magnetism (for example, Ni—Zn—Cu ferrite, Ni—Zn ferrite, or the like). The nonmagnetic portions 32*b* to 32*g* are produced from nonmagnetic (that is, the magnetic permeability is 1) ferrite (for example, Zn—Cu ferrite). However, instead of the nonmagnetic portions 32*b* to 32*g*, low-magnetic portions having a magnetic permeability lower than the magnetic permeability of the magnetic portions 30*b* to 30*g* may be used. The track R will be described with reference to FIG. 3A and FIG. 3B before the shapes of the magnetic portions 30*b* to 30*g* and the nonmagnetic portions 32*b* to 32*g* are described.

In the electronic component 10, the track R is defined as shown in FIG. 3A. The track R has a substantially tetragonal (rectangular in the present embodiment) frame shape and is composed of sides L1 (an example of a first side), L2 (an example of a second side), L3 (an example of a third side), and L4 (an example of a fourth side), which are connected in that order in the counterclockwise direction (an example of a predetermined direction). The corners of the track R are chamfered. The sides L1 and L3 are short sides extending in the forward or backward direction and the sides L2 and L4 are long sides extending in the lateral direction.

The corner formed by the side L1 and the side L4 is defined as a corner C1 (an example of a first corner). The corner formed by the side L1 and the side L2 is defined as a corner C2 (an example of a second corner). The corner formed by the side L2 and the side L3 is defined as a corner C3 (an example of a third corner). The corner formed by the side L3 and the side L4 is defined as a corner C4 (an example of a fourth corner).

The borders between the sides L1 to L4 and the corners C1 to C4 will be described. The corners C1 to C4 of the track R are chamfered. The corner C1 is a region surrounded by a thick line shown in FIG. 3A and is, specifically, a region surrounded by an arc portion c1 in an outer edge portion of the track R, an arc portion c2 in an inner edge portion of the track R, a straight line portion l1 connecting one end of the arc portion c1 to one end of the arc portion c2, and a straight line portion l2 connecting the other end of the arc portion c1 to the other end of the arc portion c2. In this regard, the corners C2 to C4 are the same as the corner C1 and, therefore, explanations thereof will not be provided.

In the case where the corners C1 to C4 of the track R are not chamfered, as shown in FIG. 3B, the corner C1 is a region surrounded by straight line portions l1 to l4. The straight line portion l1 is a straight line extending from the inner corner of the track R toward the left side. The straight line portion l2 is a straight line extending from the inner corner of the track R forward. The straight line portion l3 is a straight line extending from the outer corner of the track R toward the right side. The straight line portion l4 is a straight line extending from the outer corner of the track R backward.

The left rear half of the corner C1 is a front end of the side L1, and the left front half of the corner C2 is the rear end of the side L1. The right rear half of the corner C2 is a left end of the side L2, and the left rear half of the corner C3 is the right end of the side L2. The right front half of the corner C3 is a rear end of the side L3, and the right rear half of the corner C4 is the front end of the side L3. The left front half of the corner C4 is a right end of the side L4, and the right front half of the corner C1 is the left end of the side L4.

The shapes of the magnetic portions 30*b* to 30*g* and the nonmagnetic portions 32*b* to 32*g* will be described. As shown in FIG. 2 and FIG. 3A, the nonmagnetic portion 32*b* is disposed in the vicinity of the right end of the side L2, the side L3, the side L4, and the left rear half of the corner C1 (that is, the front end of the side L1). The vicinity of the right end of the side L2 refers to the right end of the side L2 (that is, the left rear half of the corner C3) and a portion adjacent to the right end, in the side L2. As shown in FIG. 2 and FIG. 3A, the nonmagnetic portion 32*c* is disposed in the right rear half of the corner C4, the side L4, the side L1, and the vicinity of the left end of the side L2. As shown in FIG. 2 and FIG. 3A, the nonmagnetic portion 32*d* is disposed in the vicinity of the left end of the side L4, the side L1, the side L2, and the right front half of the corner C3 (that is, the rear end of the side L3). As shown in FIG. 2 and FIG. 3A, the nonmagnetic portion 32*e* is disposed in the left front half of the corner C2, the side L2, the side L3, and the vicinity of the right end of the side L4. As shown in FIG. 2 and FIG. 3A, the nonmagnetic portion 32*f* is disposed in the vicinity of the right end of the side L2, the side L3, the side L4, and the left rear half of the corner C1 (that is, the front end of the side L1). As shown in FIG. 2 and FIG. 3A, the nonmagnetic portion 32*g* is disposed in the right rear half of the corner C4 (that is, the front end of the side L3), the side L4, the side L1, and the vicinity of the left end of the side L2.

The magnetic portions 30*c* to 30*f* are portions other than the track R in the insulator layers 16*c* to 16*f*. The magnetic portion 30*b* is a portion other than the track R and the lead conductor layer 24*a*, described later, in the insulator layer 16*b*. The magnetic portion 30*g* is a portion other than the track R and the lead conductor layer 24*b*, described later, in the insulator layer 16*g*.

As shown in FIG. 2, the coil L includes coil conductor layers 18*a* to 18*f*, and has a spiral shape spiraling downward in the clockwise direction, when viewed from above. The coil conductor layers 18*a* to 18*f* are disposed in the multilayer body 12 and are arranged in that order from top to bottom. The coil conductor layers 18*a* to 18*f* overlap one another so as to form the track R, when viewed from above. The coil conductor layers 18*a* to 18*f* will be described below in detail with reference to FIG. 2 and FIG. 4A. In FIG. 4A, both ends of each of the coil conductor layers 18*a* to 18*f* are expressed as open circles so as to indicate that the coil conductor layers 18*a* to 18*f* are not disposed at the respective corners C1 to C4 expressed as open circles. In this regard, in FIG. 11B and the like described later, both ends of each of the coil conductor layers 18*a* to 18*f* are expressed as solid circles so as to indicate that the coil conductor layers 18*a* to 18*f* are disposed at the respective corners C1 to C4 expressed as solid circles.

As shown in FIG. 2 and FIG. 4A, the coil conductor layer 18*a* (an example of a first coil conductor layer) lies astride the sides L1 and L2 and has the shape of substantially the letter L, when viewed from above. The coil conductor layer 18*a* is disposed in the insulator layer 16*b* so as to penetrate the insulator layer 16*b* in the vertical direction. That is, the thickness of the coil conductor layer 18*a* is substantially equal to the thickness of the insulator layer 16*b*. Consequently, the coil conductor layer 18*a* having the shape of substantially the letter L is exposed when the insulator layer 16*b* is viewed from above and when the insulator layer 16*b* is viewed from below.

The coil conductor layer 18*a* is disposed in a portion excluding the corner C1 of the side L1 and a portion excluding the vicinity of the right end of the side L2. Therefore, as shown in FIG. 2 and FIG. 4A, the coil conductor layer 18*a* is not disposed at the corners C1 and C3. Hereafter in the coil conductor layer 18*a*, a portion overlapping the side L1 is referred to as a portion 20*a* and in the coil conductor layer 18*a*, a portion overlapping the side L2 is referred to as a portion 22*a*. As shown in FIG. 2, the portion 22*a* (that is, the coil conductor layer 18*a*) is disposed in the portion excluding the vicinity of the right end of the side L2 and, therefore, is not in contact with the corner C3. That is, the nonmagnetic portion 32*b* is present between the right end of the portion 22*a* and the corner C3. The coil conductor layer 18*a* constitutes the track R by being combined with the nonmagnetic portion 32*b*, when viewed from above.

As shown in FIG. 2 and FIG. 4A, the coil conductor layer 18*b* (an example of a second coil conductor layer) lies astride the sides L2 and L3 and has the shape of substantially the letter L, when viewed from above. The coil conductor layer 18*b* is disposed in the insulator layer 16*c* so as to penetrate the insulator layer 16*c* in the vertical direction. That is, the thickness of the coil conductor layer 18*b* is substantially equal to the thickness of the insulator layer 16*c*. Consequently, the coil conductor layer 18*b* having the shape of substantially the letter L is exposed when the insulator layer 16*c* is viewed from above and when the insulator layer 16*c* is viewed from below.

The coil conductor layer 18*b* is disposed in a portion excluding the vicinity of the left end of the side L2 and a portion excluding the corner C4 of the side L3. Therefore, as shown in FIG. 2 and FIG. 4A, the coil conductor layer 18*b* is not disposed at the corners C2 and C4. Hereafter in the coil conductor layer 18*b*, a portion overlapping the side L2 is referred to as a portion 20*b* and in the coil conductor layer 18*b*, a portion overlapping the side L3 is referred to as a portion 22*b*. As shown in FIG. 2, the portion 20*b* (that is, the coil conductor layer 18*b*) is disposed in the portion excluding the vicinity of the left end of the side L2 and, therefore, is not in contact with the corner C2. That is, the nonmagnetic portion 32*c* is present between the left end of the portion 20*b* and the corner C2. The coil conductor layer 18*b* constitutes the track R by being combined with the nonmagnetic portion 32*c*, when viewed from above. The portion 20*b* of the coil conductor layer 18*b* is connected to the portion 22*a* (coil conductor layer 18*a*).

As shown in FIG. 2 and FIG. 4A, the coil conductor layer 18*c* (an example of a third coil conductor layer) lies astride the sides L3 and L4 and has the shape of substantially the letter L, when viewed from above. The coil conductor layer 18*c* is disposed in the insulator layer 16*d* so as to penetrate the insulator layer 16*d* in the vertical direction. That is, the thickness of the coil conductor layer 18*c* is substantially equal to the thickness of the insulator layer 16*d*. Consequently, the coil conductor layer 18*c* having the shape of substantially the letter L is exposed when the insulator layer 16*d* is viewed from above and when the insulator layer 16*d* is viewed from below.

The coil conductor layer 18*c* is disposed in a portion excluding the corner C3 of the side L3 and a portion excluding the vicinity of the left end of the side L4. Therefore, as shown in FIG. 2 and FIG. 4A, the coil conductor layer 18*c* is not disposed at the corners C1 and C3. Hereafter in the coil conductor layer 18*c*, a portion overlapping the side L3 is referred to as a portion 20*c* and in the coil conductor layer 18*c*, a portion overlapping the side L4 is referred to as a portion 22*c*. As shown in FIG. 2, the portion 22*c* (that is, the coil conductor layer 18*c*) is disposed in the portion excluding the vicinity of the left end of the side L4 and, therefore, is not in contact with the corner C1. That is, the nonmagnetic portion 32*d* is present between the left end of the portion 22*c* and the corner C1. The coil conductor layer 18*c* constitutes the track R by being combined with the nonmagnetic portion 32*d*, when viewed from above. The portion 20*c* of the coil conductor layer 18*c* is connected to the portion 22*b* (coil conductor layer 18*b*).

As shown in FIG. 2 and FIG. 4A, the coil conductor layer 18*d* (an example of a fourth coil conductor layer) lies astride the sides L4 and L1 and has the shape of substantially the letter L, when viewed from above. The coil conductor layer 18*d* is disposed in the insulator layer 16*e* so as to penetrate the insulator layer 16*e* in the vertical direction. That is, the thickness of the coil conductor layer 18*d* is substantially equal to the thickness of the insulator layer 16*e*. Consequently, the coil conductor layer 18*d* having the shape of substantially the letter L is exposed when the insulator layer 16*e* is viewed from above and when the insulator layer 16*e* is viewed from below.

The coil conductor layer 18*d* is disposed in a portion excluding the vicinity of the right end of the side L4 and a portion excluding the corner C2 of the side L1. Therefore, as shown in FIG. 2 and FIG. 4A, the coil conductor layer 18*d* is not disposed at the corners C2 and C4. Hereafter in the coil conductor layer 18*d*, a portion overlapping the side L4 is referred to as a portion 20*d* and in the coil conductor layer 18*d*, a portion overlapping the side L1 is referred to as a portion 22*d*. As shown in FIG. 2, the portion 20*d* (that is, the coil conductor layer 18*d*) is disposed in the portion excluding the vicinity of the right end of the side L4 and, therefore, is not in contact with the corner C4. That is, the nonmagnetic portion 32*e* is present between the right end of the portion 20*d* and the corner C4. The coil conductor layer 18*d* constitutes the track R by being combined with the nonmagnetic portion 32*e*, when viewed from above. The portion 20*d* of the coil conductor layer 18*d* is connected to the portion 22*c* (coil conductor layer 18*c*).

As shown in FIG. 2 and FIG. 4A, the coil conductor layer 18*e* (an example of a fifth coil conductor layer) lies astride the sides L1 and L2 and has the shape of substantially the letter L, when viewed from above. The coil conductor layer 18*e* is disposed in the insulator layer 16*f* so as to penetrate the insulator layer 16*f* in the vertical direction. That is, the thickness of the coil conductor layer 18*e* is substantially equal to the thickness of the insulator layer 16*f*. Consequently, the coil conductor layer 18*e* having the shape of substantially the letter L is exposed when the insulator layer 16*f* is viewed from above and when the insulator layer 16*f* is viewed from below.

The coil conductor layer 18*e* is disposed in a portion excluding the corner C1 of the side L1 and a portion excluding the vicinity of the right end of the side L2. Therefore, as shown in FIG. 2 and FIG. 4A, the coil conductor layer 18*e* is not disposed at the corners C1 and C3. Hereafter in the coil conductor layer 18*e*, a portion overlapping the side L1 is referred to as a portion 20*e* and in the coil conductor layer 18*e*, a portion overlapping the side L2 is referred to as a portion 22*e*. As shown in FIG. 2, the portion 22*e* (that is, the coil conductor layer 18*e*) is disposed in the portion excluding the vicinity of the right end of the side L2 and, therefore, is not in contact with the corner C3. That is, the nonmagnetic portion 32*f* is present between the right end of the portion 22*e* and the corner C3. The coil conductor layer 18*e* constitutes the track R by being combined with the nonmagnetic portion 32*f*, when viewed from above. The portion 20*e* of the coil conductor layer 18*e* is connected to the portion 22*d* (coil conductor layer 18*d*).

As shown in FIG. 2 and FIG. 4A, the coil conductor layer 18*f* (an example of a sixth coil conductor layer) lies astride the side L2 and L3 and has the shape of substantially the letter L, when viewed from above. The coil conductor layer 18*f* is disposed in the insulator layer 16*g* so as to penetrate the insulator layer 16*g* in the vertical direction. That is, the thickness of the coil conductor layer 18*f* is substantially equal to the thickness of the insulator layer 16*g*. Consequently, the coil conductor layer 18*f* having the shape of substantially the letter L is exposed when the insulator layer 16*g* is viewed from above and when the insulator layer 16*g* is viewed from below.

The coil conductor layer 18*f* is disposed in a portion excluding the vicinity of the left end of the side L2 and a portion excluding the corner C4 of the side L3. Therefore, as shown in FIG. 2 and FIG. 4A, the coil conductor layer 18*f* is not disposed at the corners C2 and C4. Hereafter in the coil conductor layer 18*f*, a portion overlapping the side L2 is referred to as a portion 20*f* and in the coil conductor layer 18*f*, a portion overlapping the side L3 is referred to as a portion 22*f*. As shown in FIG. 2, the portion 20*f* (that is, the coil conductor layer 18*f*) is disposed in the portion excluding the vicinity of the left end of the side L2 and, therefore, is not in contact with the corner C2. That is, the nonmagnetic portion 32*g* is present between the left end of the portion 20*f* and the corner C2. The coil conductor layer 18*f* constitutes the track R by being combined with the nonmagnetic portion 32*g*, when viewed from above. The portion 20*f* of the coil conductor layer 18*f* is connected to the portion 22*e* (coil conductor layer 18*e*).

The lead conductor layer 24*a* is disposed in the insulator layer 16*b* so as to penetrate the insulator layer 16*b* in the vertical direction. As shown in FIG. 2 and FIG. 4B, the lead conductor layer 24*a* is connected to the portion 20*a* of the coil conductor layer 18*a* and is exposed at the left side of the insulator layer 16*b* to outside the multilayer body 12.

The lead conductor layer 24*b* is disposed in the insulator layer 16*g* so as to penetrate the insulator layer 16*g* in the vertical direction. As shown in FIG. 2 and FIG. 4B, the lead conductor layer 24*b* is connected to the portion 22*f* of the coil conductor layer 18*f* and is exposed at the right side of the insulator layer 16*g* to outside the multilayer body 12.

The above-described coil conductor layers 18*a* to 18*f* and the lead conductor layers 24*a* and 24*b* are produced from a conductor containing, for example, silver or copper as a primary component.

As shown in FIG. 1 and FIG. 4B, outer electrode 14*a* covers the entire left surface of the multilayer body 12 and, in addition, extends on the upper surface, the lower surface, the front surface, and the rear surface of the multilayer body 12. Consequently, the outer electrode 14*a* is connected to the lead conductor layer 24*a*. As shown in FIG. 1 and FIG. 4B, outer electrode 14*b* covers the entire right surface of the multilayer body 12 and, in addition, extends on the upper surface, the lower surface, the front surface, and the rear surface of the multilayer body 12. Consequently, the outer electrode 14*b* is connected to the lead conductor layer 24*b*. The outer electrodes 14*a* and 14*b* are formed by applying Ni plating and Sn plating to an underlying electrode formed from a material containing, for example, silver as a primary component.

Manufacturing Method

A method for manufacturing the electronic component 10 will be described below with reference to FIG. 5 to FIG. 11A. FIG. 5 to FIG. 11A are plan views showing the manner at the time of production of the electronic component 10. In this regard, FIG. 5 to FIG. 11A show the manner at the time of production of one electronic component 10. However, at the time of the actual production, a mother multilayer body is produced and, thereafter, the mother multilayer body is cut into a plurality of multilayer bodies 12.

A first ceramic slurry serving as the raw material for the insulator layers 16*a* and 16*h* and the magnetic portions 30*b* to 30*g* is produced. Each of the materials is weighed and the raw material composed of about 48.0 percent by mole of ferric oxide ($Fe_2O_3$), about 20.0 percent by mole of zinc oxide (ZnO), about 23.0 percent by mole of nickel oxide (NiO), and about 9.0 percent by mole of copper oxide (CuO) is put into a ball mill so as to perform wet mixing. The resulting mixture is dried and is pulverized. The resulting powder is calcined at about 750° C. for about 1 hour. The resulting calcined powder is wet-pulverized in a ball mill, and drying and disintegration are performed so as to obtain a ferrite ceramic powder.

A binder (vinyl acetate, water-soluble acryl, or the like), a plasticizer, a wetting agent, and a dispersing agent are added to the resulting ferrite ceramic powder, mixing is performed in a ball mill and, thereafter, degassing is performed under reduced pressure. In this manner, the first ceramic slurry serving as the raw material for the insulator layers 16*a* and 16*h* and the magnetic portions 30*b* to 30*g* is produced.

A second ceramic slurry serving as the raw material for the nonmagnetic portions 32*b* to 32*g* is produced. Each of the materials is weighed and the raw material composed of about 48.0 percent by mole of ferric oxide ($Fe_2O_3$), about 43.0 percent by mole of zinc oxide (ZnO), and about 9.0 percent by mole of copper oxide (CuO) is put into a ball mill so as to perform wet mixing. The resulting mixture is dried and is pulverized. The resulting powder is calcined at about 750° C. for about 1 hour. The resulting calcined powder is wet-pulverized in a ball mill, and drying and disintegration are performed so as to obtain a ferrite ceramic powder.

A binder (vinyl acetate, water-soluble acryl, or the like), a plasticizer, a wetting agent, and a dispersing agent are added to the resulting ferrite ceramic powder, mixing is performed in a ball mill and, thereafter, degassing is performed under reduced pressure. In this manner, the second ceramic slurry serving as the raw material for the nonmagnetic portions 32*b* to 32*g* is produced.

Figure 5:
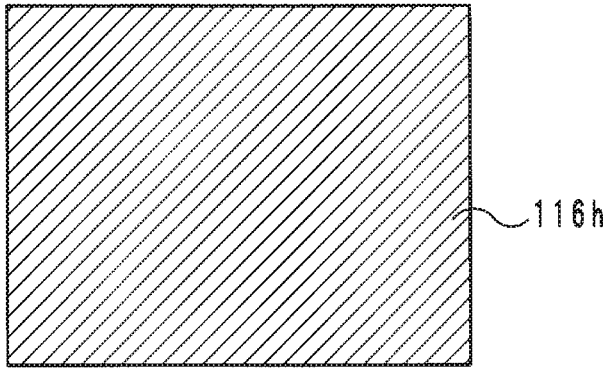
FIG. 5 is a diagram showing the manner at the time of production of the electronic component in plan view.

As shown in FIG. 5, a ceramic green layer 116*h* serving as the insulator layer 16*h* is formed by printing of the first ceramic slurry.

Figure 6:
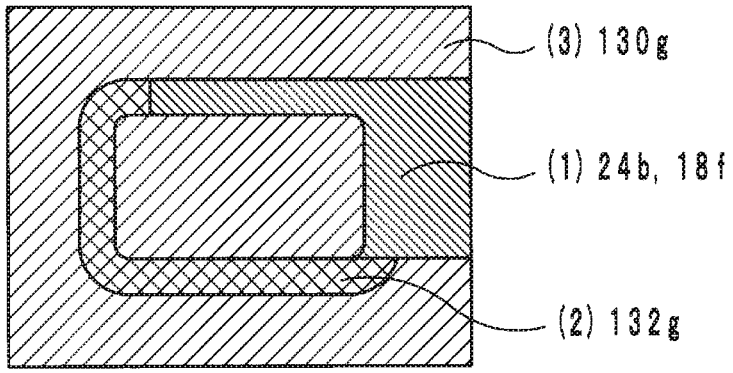
FIG. 6 is a diagram showing the manner at the time of production of the electronic component in plan view.
Figure 7:
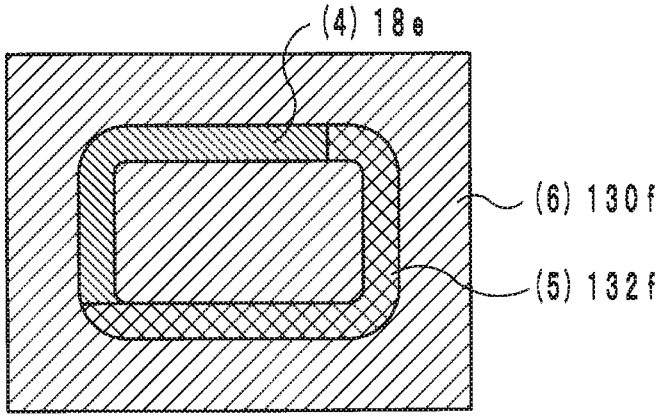
FIG. 7 is a diagram showing the manner at the time of production of the electronic component in plan view.
Figure 8:
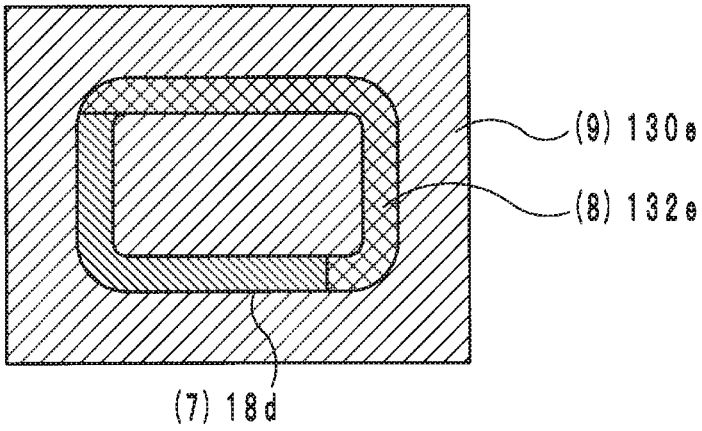
FIG. 8 is a diagram showing the manner at the time of production of the electronic component in plan view.
Figure 9:
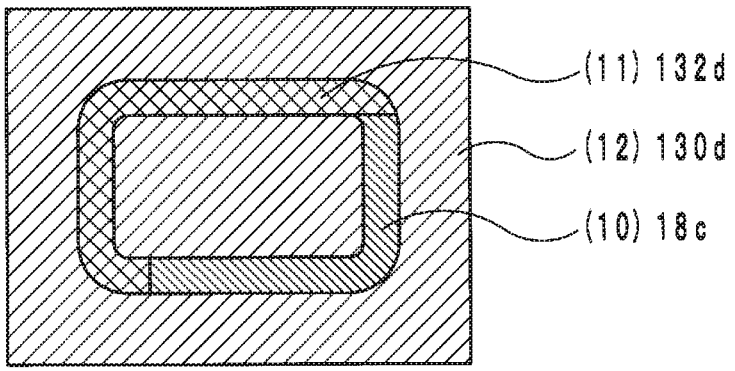
FIG. 9 is a diagram showing the manner at the time of production of the electronic component in plan view.
Figure 10:
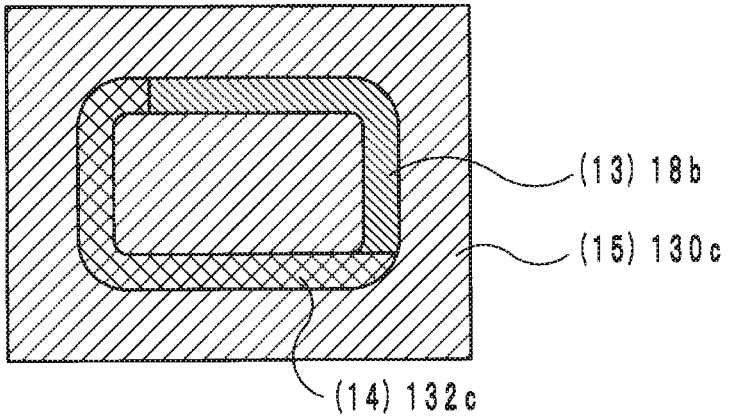
FIG. 10 is a diagram showing the manner at the time of production of the electronic component in plan view.

As shown in FIG. 6 (1), the ceramic green layers 116*h* are coated with an electrically conductive paste containing Ag, Pd, Cu, Au, or an alloy thereof as a primary component by a screen printing method, a photolithography method, or the like so as to form a coil conductor layer 18*f* and the lead conductor layer 24*b*.

As shown in FIG. 6 (2), the ceramic green layer 116*h* is coated with the second ceramic slurry by the screen printing method so as to form the ceramic green portion 132*g* serving as the nonmagnetic portion 32*g*.

As shown in FIG. 6 (3), the ceramic green layer 116*h* is coated with the first ceramic slurry by the screen printing method so as to form the ceramic green portion 130*g* serving as the magnetic portion 30*g*.

Subsequently, the steps shown in FIG. 6 (1), (2) and (3) are repeated and, thereby, ceramic green portions 130*b* to 130*f* and 132*b* to 132*f*, coil conductor layers 18*a* to 18*e*, and the lead conductor layer 24*a* are formed, as shown in FIG. 7 to FIG. 11A.

A ceramic green layer 116*a* (not shown in the drawing) serving as the insulator layer 16*a* is formed by applying the first ceramic slurry by the screen printing method so as to cover the ceramic green portions 130*b* and 132*b*, coil conductor layer 18*a*, and the lead conductor layer 24*a*. A mother multilayer body is formed through the above-described steps. The mother multilayer body is subjected to regular pressure bonding by isostatic press or the like. The regular pressure bonding is performed at about 45° C. and about 1.0 t/cm$^2$, for example.

The mother multilayer body is cut into a multilayer body 12 having a predetermined size (for example, about 3.2 mm×2.5 mm×0.8 mm). In this manner, an unfired multilayer body 12 is produced. The unfired multilayer body 12 is subjected to a debinder treatment and firing. The debinder treatment is performed in a low-oxygen environment at about 500° C. for about 2 hours, for example. The firing is performed in the air at about 890° C. for about 2.5 hours, for example.

A fired multilayer body 12 is produced by the above-described steps. The multilayer body 12 is subjected to barrel finishing so as to be chamfered. Then, an electrically conductive paste containing silver as a primary component is applied by a dipping method or the like and baking is performed so as to form underlying electrodes serving as the outer electrodes 14A and 14*b*. The underlying electrodes are dried at about 100° C. for about 10 minutes, and the underlying electrodes are baked at about 780° C. for 2.5 hours.

Finally, Ni plating/Sn plating is applied to the surface of the underlying electrodes so as to form the outer electrodes

14*a* and 14*b*. The electronic component 10 as shown in FIG. 1 is completed through the above-described steps.

Advantage

Figure 11A:
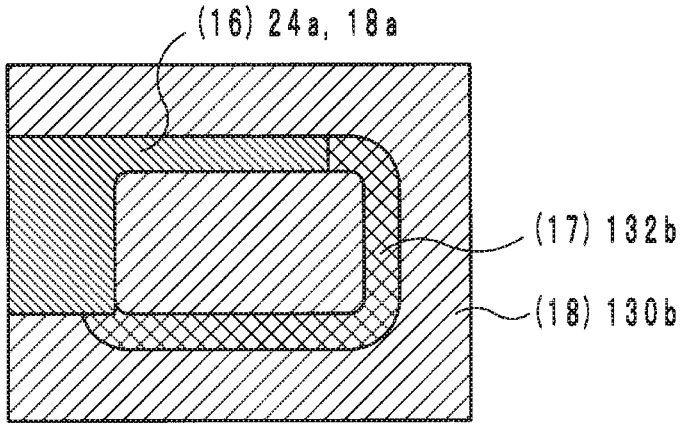
FIG. 11A is a diagram showing the manner at the time of production of the electronic component in plan view.
Figure 11B:
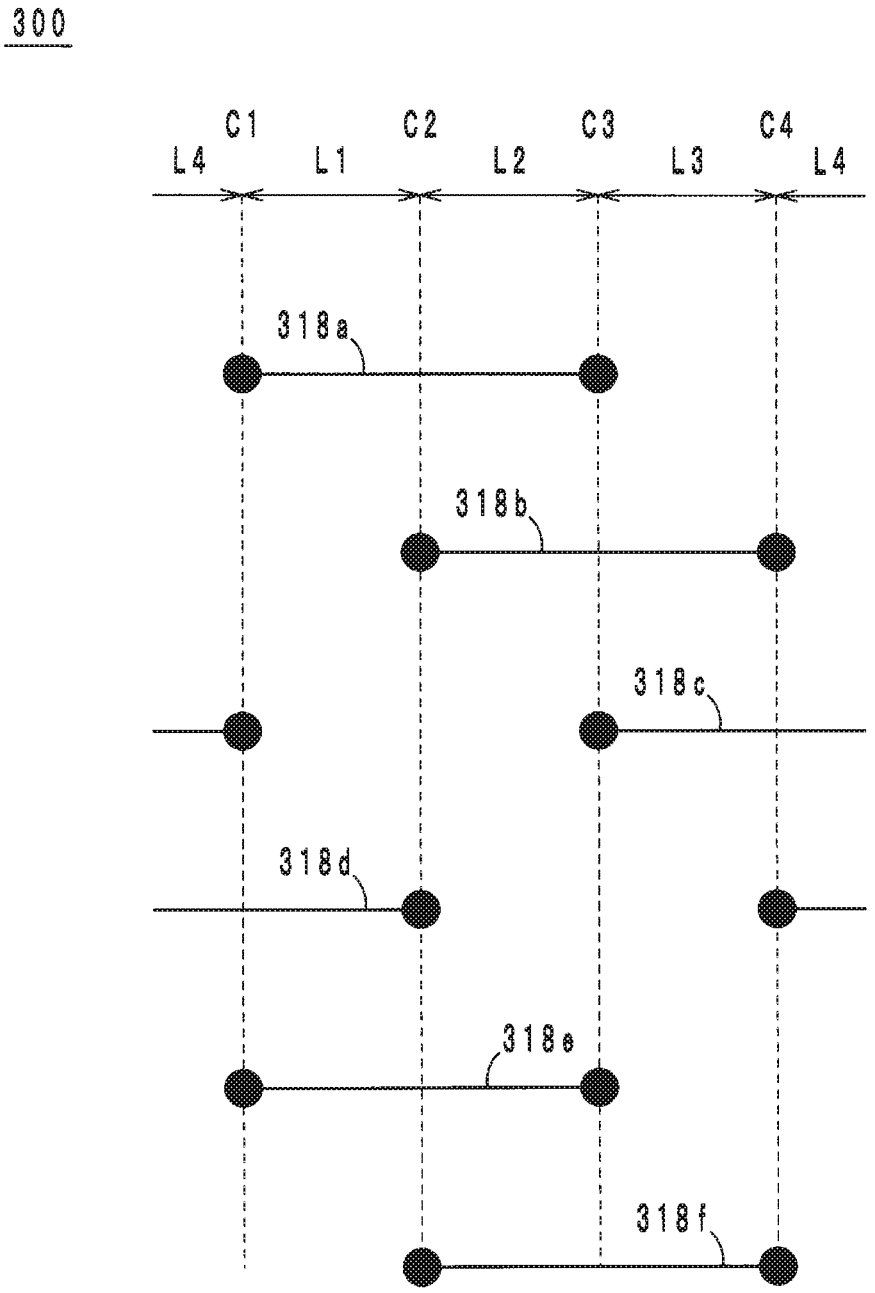
FIG. 11B is a diagram showing the positional relationship between coil conductor layers in an electronic component according to a comparative example.

The electronic component 10 according to the present embodiment can suppress an occurrence of short-circuit in the coil L. FIG. 11B is a diagram showing the positional relationship between coil conductor layers 318*a* to 318*f* in an electronic component 300 according to a comparative example.

The electronic component 300 according to the comparative example has the same structure as the structure of the multilayer electronic component described in Japanese Unexamined Patent Application Publication No. 2010-183007. In the electronic component 300, both ends of each of the coil conductor layers 318*a* to 318*f* are disposed at the respective corners C1 to C4, when viewed from above. Therefore, at the corner C1, the end portion of the coil conductor layer 318*a* and the end portion of the coil conductor layer 318*c* are opposite to each other with one insulator layer interposed therebetween. At the corner C2, the end portion of the coil conductor layer 318*b* and the end portion of the coil conductor layer 318*d* are opposite to each other with one insulator layer interposed therebetween. At the corner C3, the end portion of the coil conductor layer 318*c* and the end portion of the coil conductor layer 318*e* are opposite to each other with one insulator layer interposed therebetween. At the corner C4, the end portion of the coil conductor layer 318*d* and the end portion of the coil conductor layer 318*f* are opposite to each other with one insulator layer interposed therebetween. Consequently, short-circuit may occur in the coil at the corners C1 to C4.

On the other hand, in the electronic component 10, each end portion of the coil conductor layers 18*a* to 18*f* is not disposed at the corners C1 to C4, when viewed from above. Consequently, at the corner C1, coil conductor layers are not opposite to each other. At the corner C2, the coil conductor layer 18*a* and the coil conductor layer 18*e* are opposite to each other with three insulator layers interposed therebetween. At the corner C3, the coil conductor layer 18*b* and the coil conductor layer 18*f* are opposite to each other with three insulator layers interposed therebetween. At the corner C4, coil conductor layers are not opposite to each other. In this manner, in the electronic component 10, the distances between the coil conductor layers at the corners C1 to C4 are larger than the distances in the electronic component 300. Consequently, an occurrence of short-circuit at the corners C1 to C4 in the coil L is suppressed.

In the electronic component 10, an increase in the direct current resistance value of the coil L can be suppressed. Specifically, each end portion of the coil conductor layers 18*a* to 18*f* is not disposed at the corners C1 to C4, when viewed from above. Consequently, at the corners C1 to C4, the thicknesses of the coil L in the vertical direction decrease and the direct current resistance values may increase. However, the line widths of the coil conductor layers 18*a* to 18*f* at the corners C1 to C4 of the track R are larger than the line widths of the coil conductor layers 18*a* to 18*f* at portions excluding the corners C1 to C4. Consequently, the amount of increase in the direct current resistance value of the coil L is reduced.

In the electronic component 10, an occurrence of short-circuit in the coil L can be suppressed and, in addition, an occurrence of break in the coil L can be suppressed for the reasons as described below. In the electronic component 300 according to the comparative example, short-circuit may occur in the coil at the corners C1 to C4. In order to suppress an occurrence of short-circuit in the coil in such an electronic component 300, for example, none of the end portions of the coil conductor layers 18*a* to 18*f* has to be disposed at the corners C1 to C4, when viewed from above.

However, even when none of the end portions of the coil conductor layers 18*a* to 18*f* is disposed at the corners C1 to C4, if the coil conductor layers 18*a* to 18*f* are in contact with the outer edge portions of the corners C1 to C4, the coil conductor layers 18*a* to 18*f* are brought close to each other at the outer edge portions of the corners C1 to C4. In order to solve such a problem, it is considered that none of the end portions of the coil conductor layers 18*a* to 18*f* is brought into contact with the outer edge portions of the corners C1 to C4. However, in this case, the portions 20*a* to 20*f* and 22*a* to 22*f* become short. In particular, if the portions 22*b*, 20*c*, 22*d*, and 20*e*, which overlap the short sides of the track R, become short, the contact area between the coil conductor layer 18*b* and the coil conductor layer 18*c* and the contact area between the coil conductor layer 18*d* and the coil conductor layer 18*e* decrease. As a result, a break may occur between the coil conductor layer 18*b* and the coil conductor layer 18*c* or between the coil conductor layer 18*d* and the coil conductor layer 18*e*.

Then, in the electronic component 10, the coil conductor layer 18*a* is in contact with the corner C1 and is not in contact with the corner C3, when viewed from above. The coil conductor layer 18*b* is in contact with the corner C4 and is not in contact with the corner C2, when viewed from above. The coil conductor layer 18*c* is in contact with the corner C3 and is not in contact with the corner C1, when viewed from above. The coil conductor layer 18*d* is in contact with the corner C2 and is not in contact with the corner C4, when viewed from above. The coil conductor layer 18*e* is in contact with the corner C1 and is not in contact with the corner C3, when viewed from above. The coil conductor layer 18*f* is in contact with the corner C4 and is not in contact with the corner C2, when viewed from above. Consequently, the portions 22*a*, 20*b*, 22*c*, 20*d*, 22*e*, and 20*f*, which overlap the long sides of the track R, become short, and the portions 22*b*, 20*c*, 22*d*, and 20*e*, which overlap the short sides of the track R, do not become short. However, the portions 22*a*, 20*b*, 22*c*, 20*d*, 22*e*, and 20*f* have sufficient lengths and, therefore, the possibility of an occurrence of a break between the coil conductor layer 18*a* and the coil conductor layer 18*b*, between the coil conductor layer 18*c* and the coil conductor layer 18*d*, or between the coil conductor layer 18*e* and the coil conductor layer 18*f* is low. As described above, in the electronic component 10, an occurrence of short-circuit in the coil L can be suppressed and, in addition, an occurrence of break in the coil L can be suppressed. However, this does not prevent the coil conductor layers 18*a* to 18*f* from coming into contact with the corners C1 to C4.

In the electronic component 10, the track R is formed by combining the nonmagnetic portions 32*b* to 32*g* and the coil conductor layers 18*a* to 18*f* with each other. Consequently, regarding the track R, the coil conductor layers 18*a* to 18*f* and the nonmagnetic portions 32*b* to 32*g* are arranged alternately in the vertical direction, as shown in FIG. 4B. Consequently, reduction of the inductance value of the coil L is suppressed in a region where the current value is small.

In the electronic component 10, the nonmagnetic portions 32 are disposed at the locations overlapping the track R but may extend off the track R. That is, the nonmagnetic portions 32 may be disposed inside and/or outside the coil L, when viewed from above. Consequently, reduction of the inductance value of the coil L is suppressed in a region where the current value is small.

First Modified Example

Figure 12:
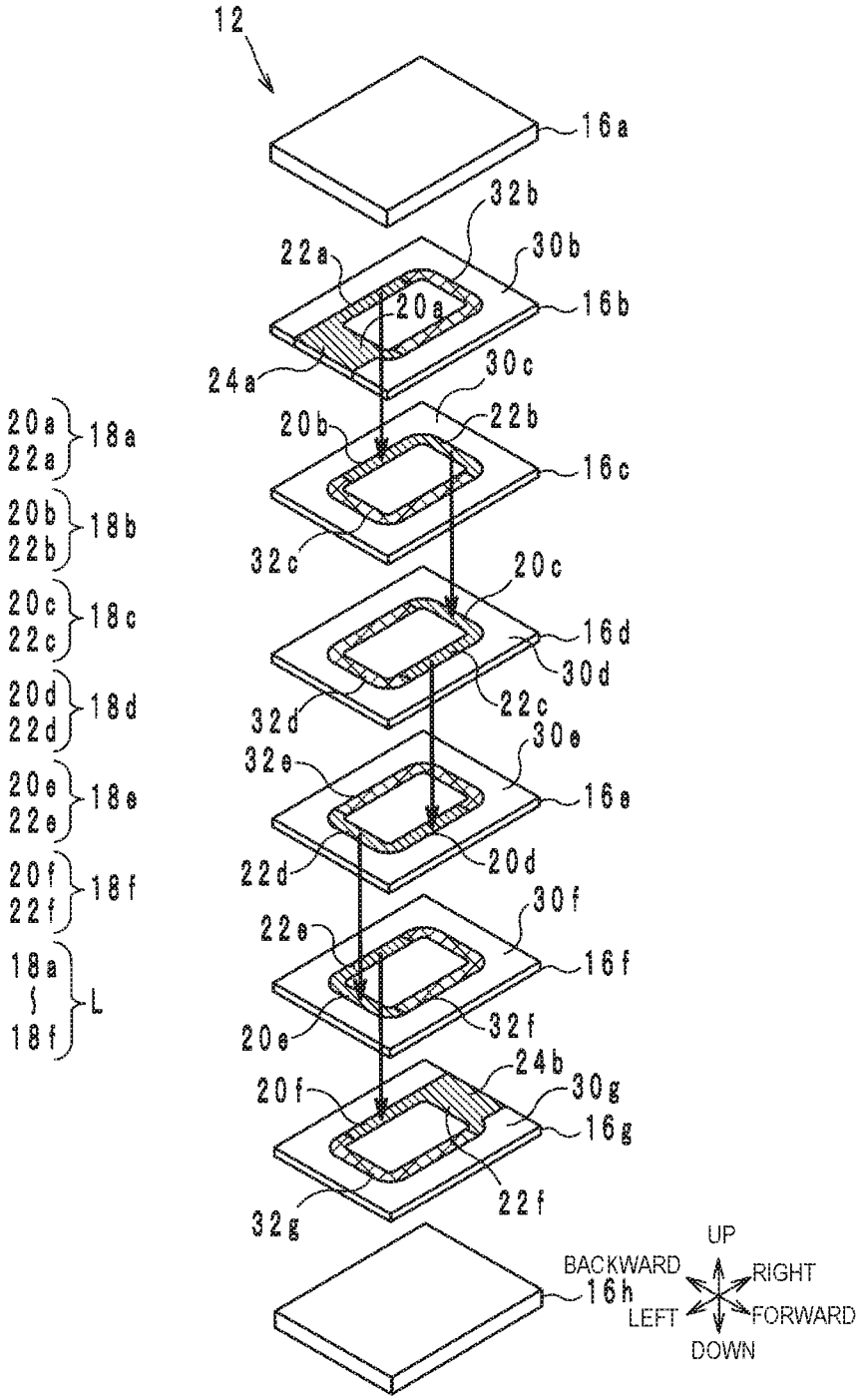
FIG. 12 is an exploded perspective view of a multilayer body of an electronic component according to a first modified example.
Figure 13:
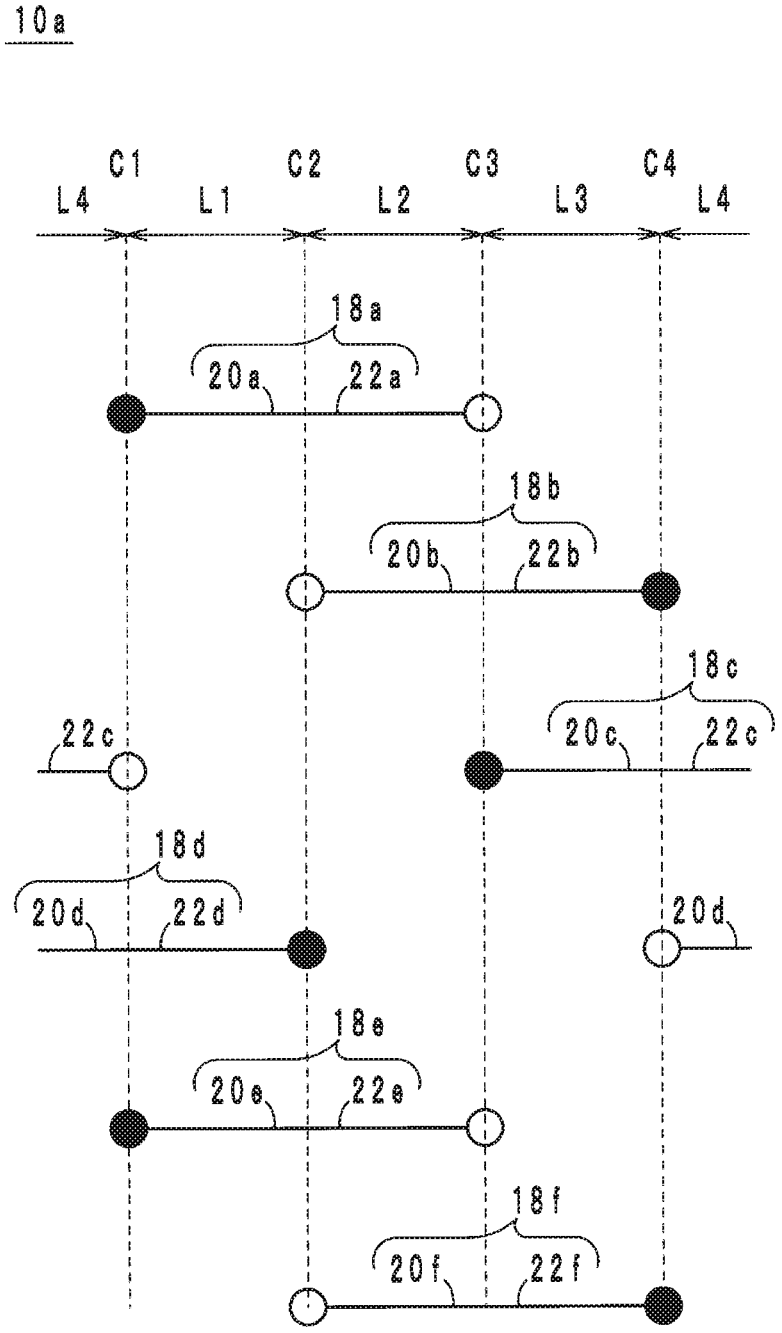
FIG. 13 is a diagram showing the positional relationship between coil conductor layers in the electronic component according to the first modified example.

An electronic component according to a first modified example will be described below with reference to the drawings. FIG. 12 is an exploded perspective view of a multilayer body 12 of an electronic component 10*a* according to the first modified example. FIG. 13 is a diagram showing the positional relationship between the coil conductor layers 18*a* to 18*f* in the electronic component 10*a* according to the first modified example. An outside perspective view of the electronic component 10*a* is referred to FIG. 1.

The electronic component 10*a* is different from the electronic component 10 in the shapes of the coil conductor layers 18*a* to 18*f*. The electronic component 10*a* will be described below centering on the different points.

In the electronic component 10*a*, as shown in FIG. 12 and FIG. 13, the coil conductor layers 18*a* and 18*e* are disposed at the corner C1 and are not disposed at the corner C3, when viewed from above. The coil conductor layers 18*b* and 18*f* are disposed at the corner C4 and are not disposed at the corner C2, when viewed from above. The coil conductor layer 18*c* is disposed at the corner C3 and is not disposed at the corner C1, when viewed from above. The coil conductor layer 18*d* is disposed at the corner C2 and is not disposed at the corner C4, when viewed from above.

In the electronic component 10*a*, an occurrence of short-circuit in the coil L can be suppressed as in the electronic component 10. Specifically, at the corner C1, the coil conductor layer 18*a* and the coil conductor layer 18*d* are opposite to each other with two insulator layers interposed therebetween. At the corner C2, the coil conductor layer 18*a* and the coil conductor layer 18*d* are opposite to each other with two insulator layers interposed therebetween. At the corner C3, the coil conductor layer 18*c* and the coil conductor layer 18*f* are opposite to each other with two insulator layers interposed therebetween. At the corner C4, the coil conductor layer 18*c* and the coil conductor layer 18*f* are opposite to each other with two insulator layers interposed therebetween. As described above, in the electronic component 10*a*, the distances between the coil conductor layers at the corners C1 to C4 are larger than the distances in the electronic component 300. Consequently, an occurrence of short-circuit at the corners C1 to C4 in the coil L can be suppressed.

In the electronic component 10*a*, an occurrence of short-circuit in the coil L can be suppressed and, in addition, an occurrence of break in the coil L can be suppressed for the same reasons as for the electronic component 10.

Second Modified Example to Fifth Modified Example

Figure 14:
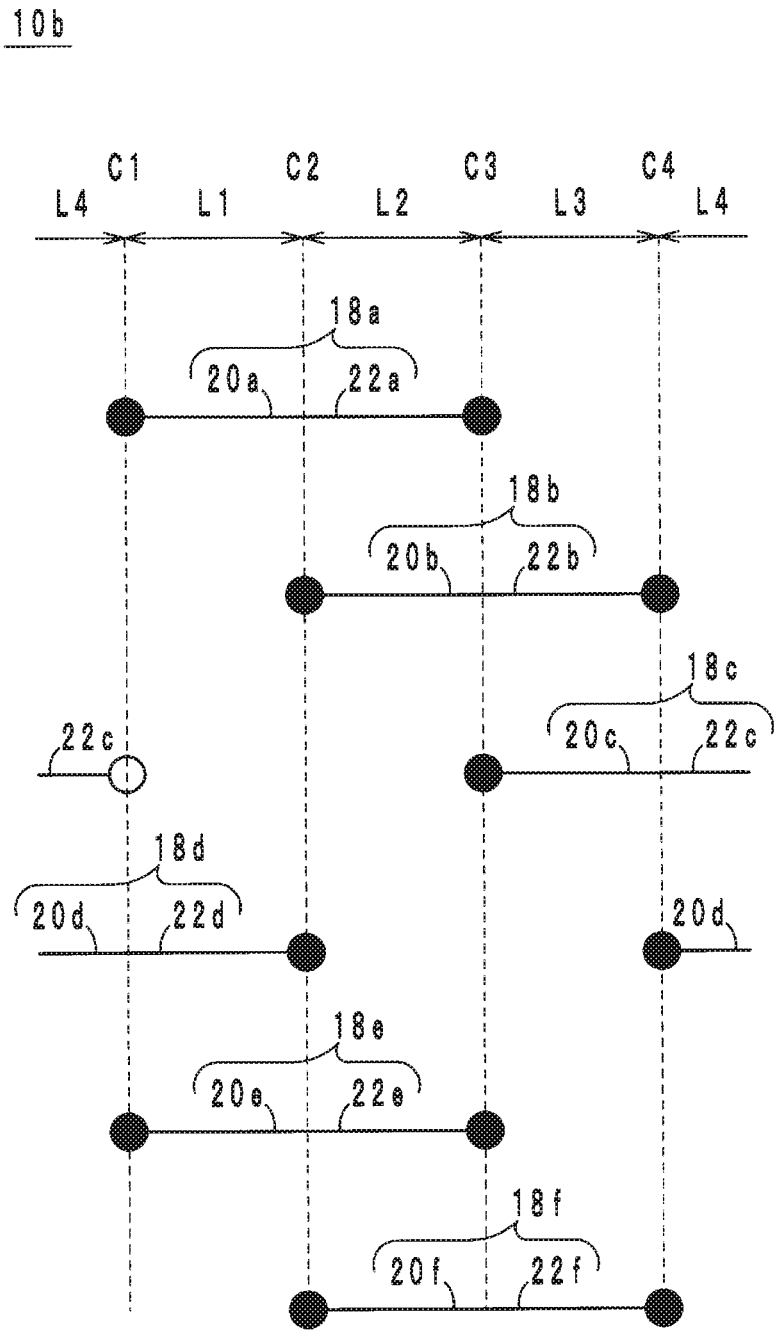
FIG. 14 is a diagram showing the positional relationship between coil conductor layers in an electronic component according to a second modified example.
Figure 15:
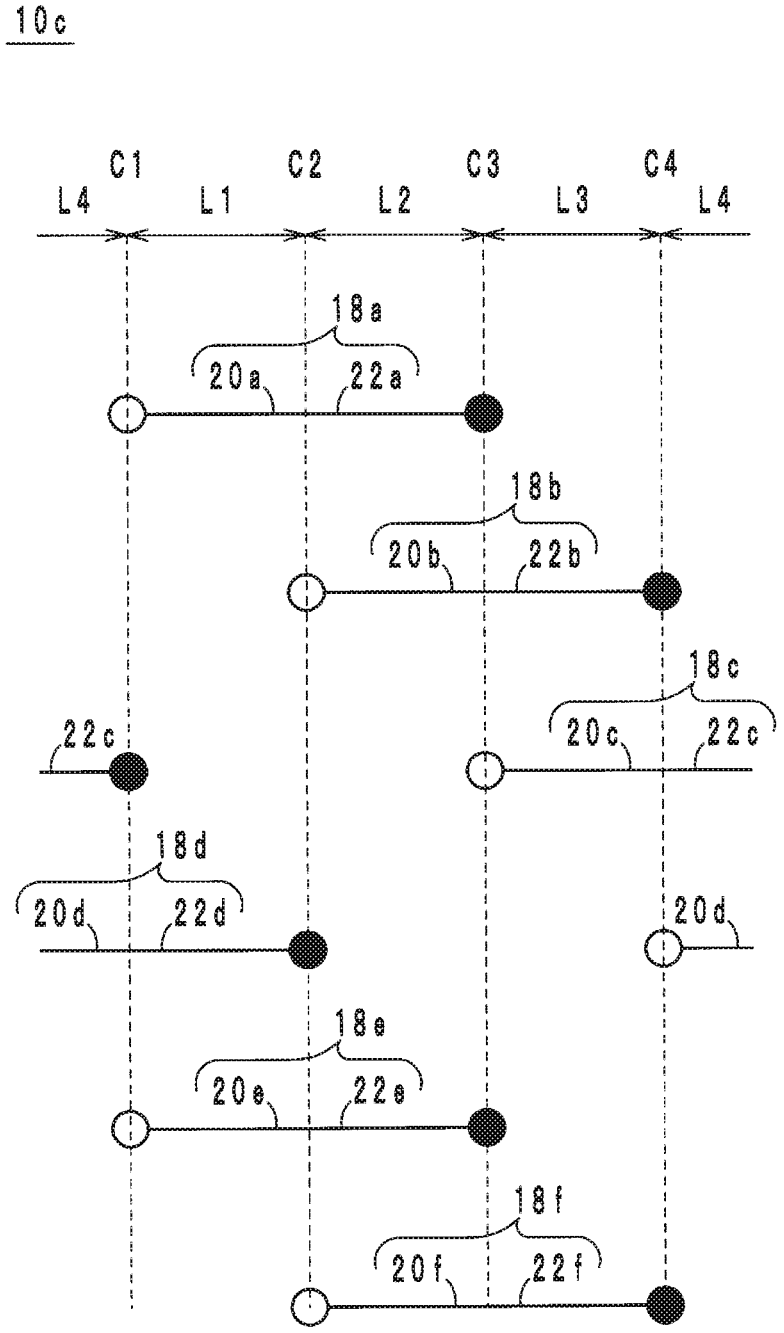
FIG. 15 is a diagram showing the positional relationship between coil conductor layers in an electronic component according to a third modified example.
Figure 16:
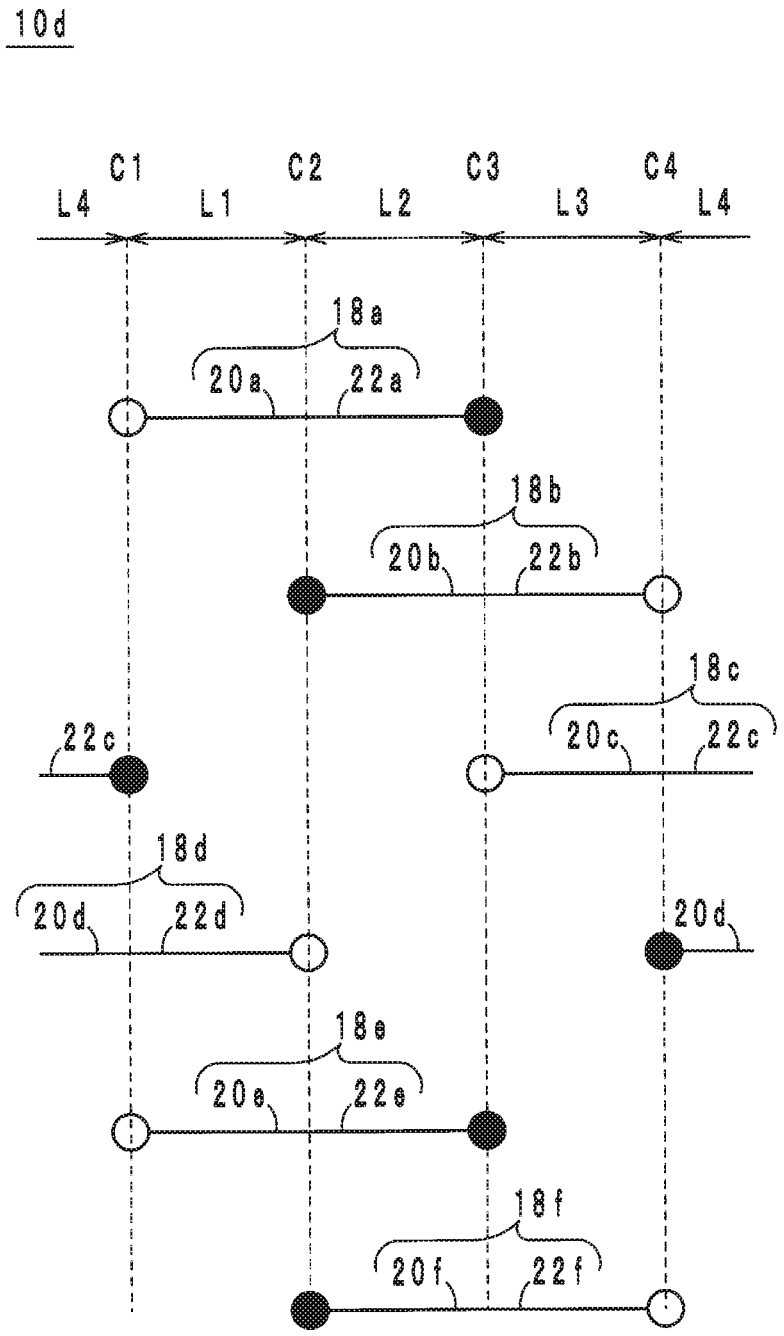
FIG. 16 is a diagram showing the positional relationship between coil conductor layers in an electronic component according to a fourth modified example.
Figure 17:
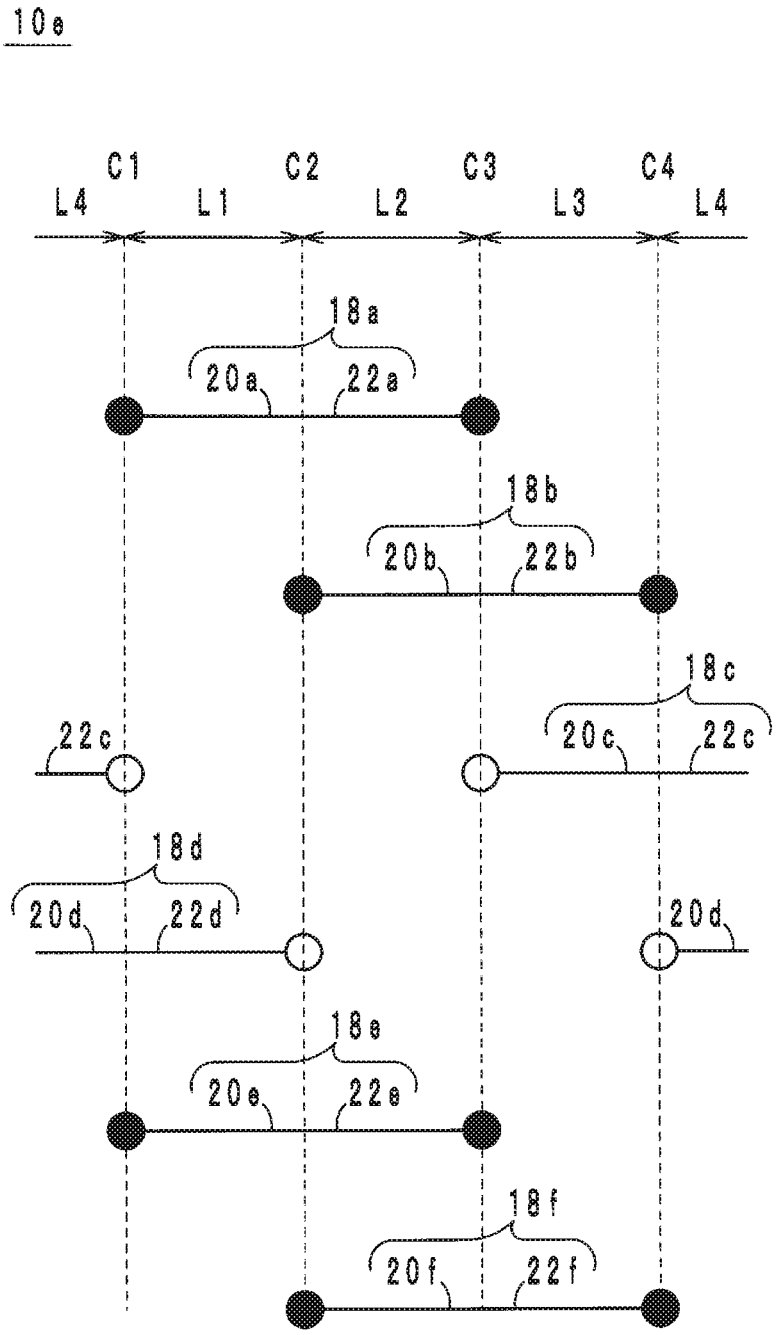
FIG. 17 is a diagram showing the positional relationship between coil conductor layers in an electronic component according to a fifth modified example.

Electronic components according to a second modified example to a fifth modified example will be described below with reference to the drawings. FIG. 14 is a diagram showing the positional relationship between the coil conductor layers 18*a* to 18*f* in an electronic component 10*b* according to a second modified example. FIG. 15 is a diagram showing the positional relationship between the coil conductor layers 18*a* to 18*f* in an electronic component 10*c* according to a third modified example. FIG. 16 is a diagram showing the positional relationship between the coil conductor layers 18*a* to 18*f* in an electronic component 10*d* according to a fourth modified example. FIG. 17 is a diagram showing the positional relationship between the coil conductor layers 18*a* to 18*f* in an electronic component 10*e* according to a fifth modified example. Outside perspective views of the electronic components 10*b* to 10*e* are referred to FIG. 1.

The electronic component 10*b* is different from the electronic component 10 in the shapes of the coil conductor layers 18*a* to 18*f*. The electronic component 10*b* will be described below centering on the different points.

In the electronic component 10*b*, as shown in FIG. 14, the coil conductor layers 18*a* and 18*e* are disposed at the corners C1 and C3, when viewed from above. The coil conductor layers 18*b* and 18*f* are disposed at the corner C2 and C4, when viewed from above. The coil conductor layer 18*c* is disposed at the corner C3 and is not disposed at the corner C1, when viewed from above. The coil conductor layer 18*d* is disposed at the corners C2 and C4, when viewed from above.

In the electronic component 10*a*, an occurrence of short-circuit in the coil L can be suppressed as in the electronic component 10. Specifically, at the corner C1, the coil conductor layer 18*a* and the coil conductor layer 18*d* are opposite to each other with two insulator layers interposed therebetween. Consequently, at the corner C1, it is avoided that the coil conductor layer 18*a* and the coil conductor layer 18*c* are opposite to each other with one insulator layer interposed therebetween, and an occurrence of short-circuit between the coil conductor layer 18*a* and the coil conductor layer 18*c* is suppressed.

As described above, it is not necessary that an occurrence of short-circuit is suppressed at all the corners C1 to C4 of the coil L. An occurrence of short-circuit in the coil L at only one corner among the corners C1 to C4 has to be suppressed. The condition, under which an occurrence of short-circuit in the coil L at the corner C1 can be suppressed, is denoted as a condition 1, the condition, under which an occurrence of short-circuit in the coil L at the corner C2 can be suppressed, is denoted as a condition 2, the condition, under which an occurrence of short-circuit in the coil L at the corner C3 can be suppressed, is denoted as a condition 3, and the condition, under which an occurrence of short-circuit in the coil L at the corner C4 can be suppressed, is denoted as a condition 4.

Condition 1

In order to suppress an occurrence of short-circuit between the coil conductor layer 18*a* (an example of the first coil conductor layer) and the coil conductor layer 18*c* (an example of the third coil conductor layer), that is, at the corner C1, it is necessary that at least one of the coil conductor layer 18*a* and the coil conductor layer 18*c* be not disposed at the corner C1, when viewed from above.

Condition 2

In order to suppress an occurrence of short-circuit between the coil conductor layer 18*b* (an example of the first coil conductor layer or the second coil conductor layer) and the coil conductor layer 18*d* (an example of the third coil conductor layer or the fourth coil conductor layer), that is, at the corner C2, it is necessary that at least one of the coil conductor layer 18*b* and the coil conductor layer 18*d* be not disposed at the corner C2, when viewed from above.

Condition 3

In order to suppress an occurrence of short-circuit between the coil conductor layer 18*c* (an example of the first coil conductor layer or the third coil conductor layer) and the coil conductor layer 18*e* (an example of the third coil conductor layer or the fifth coil conductor layer), that is, at the corner C3, it is necessary that at least one of the coil conductor layer 18*c* and the coil conductor layer 18*e* be not disposed at the corner C3, when viewed from above.

Condition 4

In order to suppress an occurrence of short-circuit between the coil conductor layer 18*d* (an example of the first coil conductor layer or the fourth coil conductor layer) and the coil conductor layer 18*f* (an example of the third coil conductor layer or the sixth coil conductor layer), that is, at the corner C4, it is necessary that at least one of the coil conductor layer 18*d* and the coil conductor layer 18*f* be not disposed at the corner C4, when viewed from above.

Any one of the above-described condition 1 to condition 4 has to be satisfied. Examples of electronic components satisfying all of the condition 1 to the condition 4 include the electronic components 10*c* to 10*e* according to the third to fifth modified examples (refer to FIG. 15 to FIG. 17). In the electronic components 10*c* to 10*e*, an occurrence of short-circuit in the coil L is suppressed at all the corners C1 to C4.

Sixth Modified Example

Figure 18:
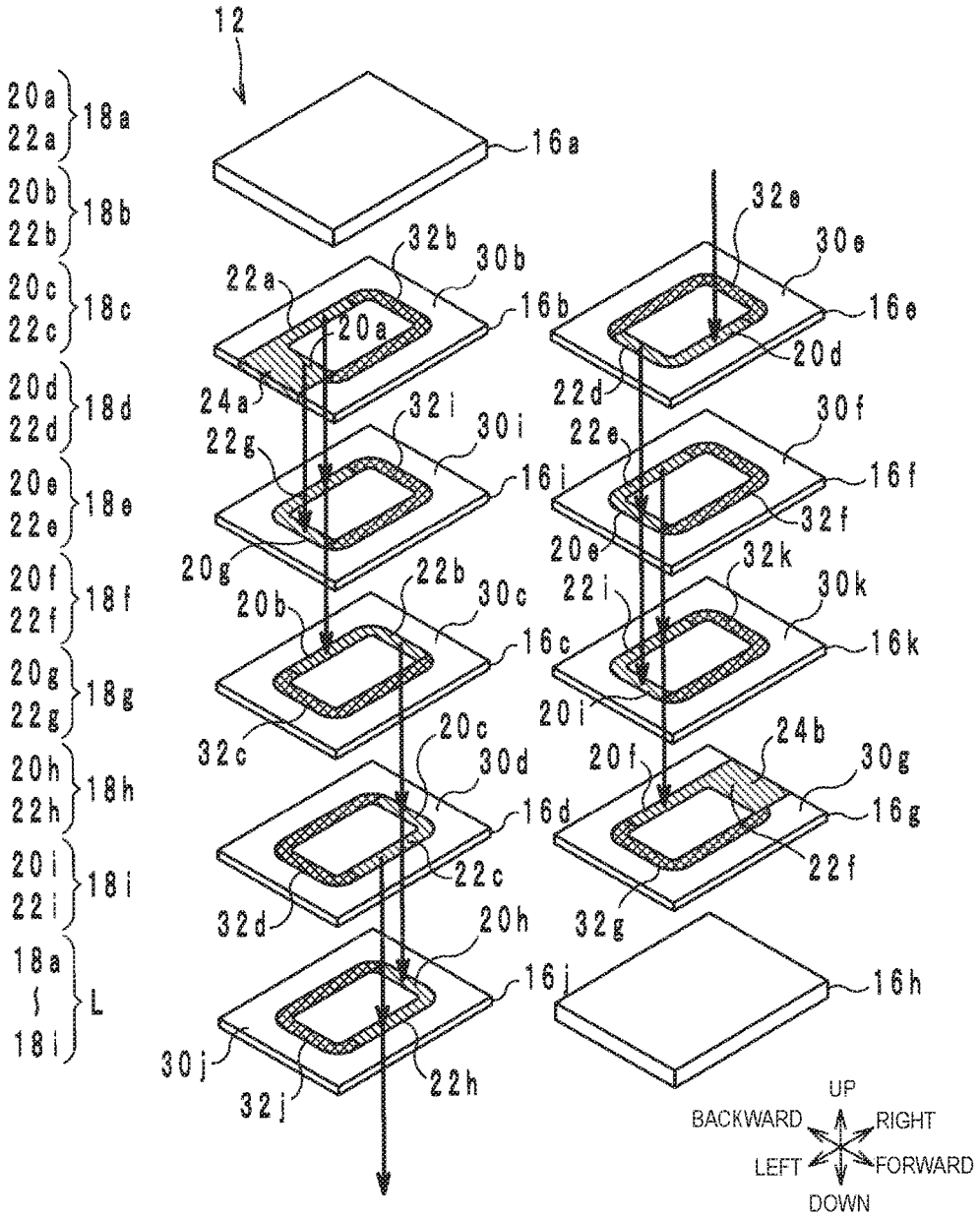
FIG. 18 is an exploded perspective view of a multilayer body of an electronic component according to a sixth modified example.
Figure 19:
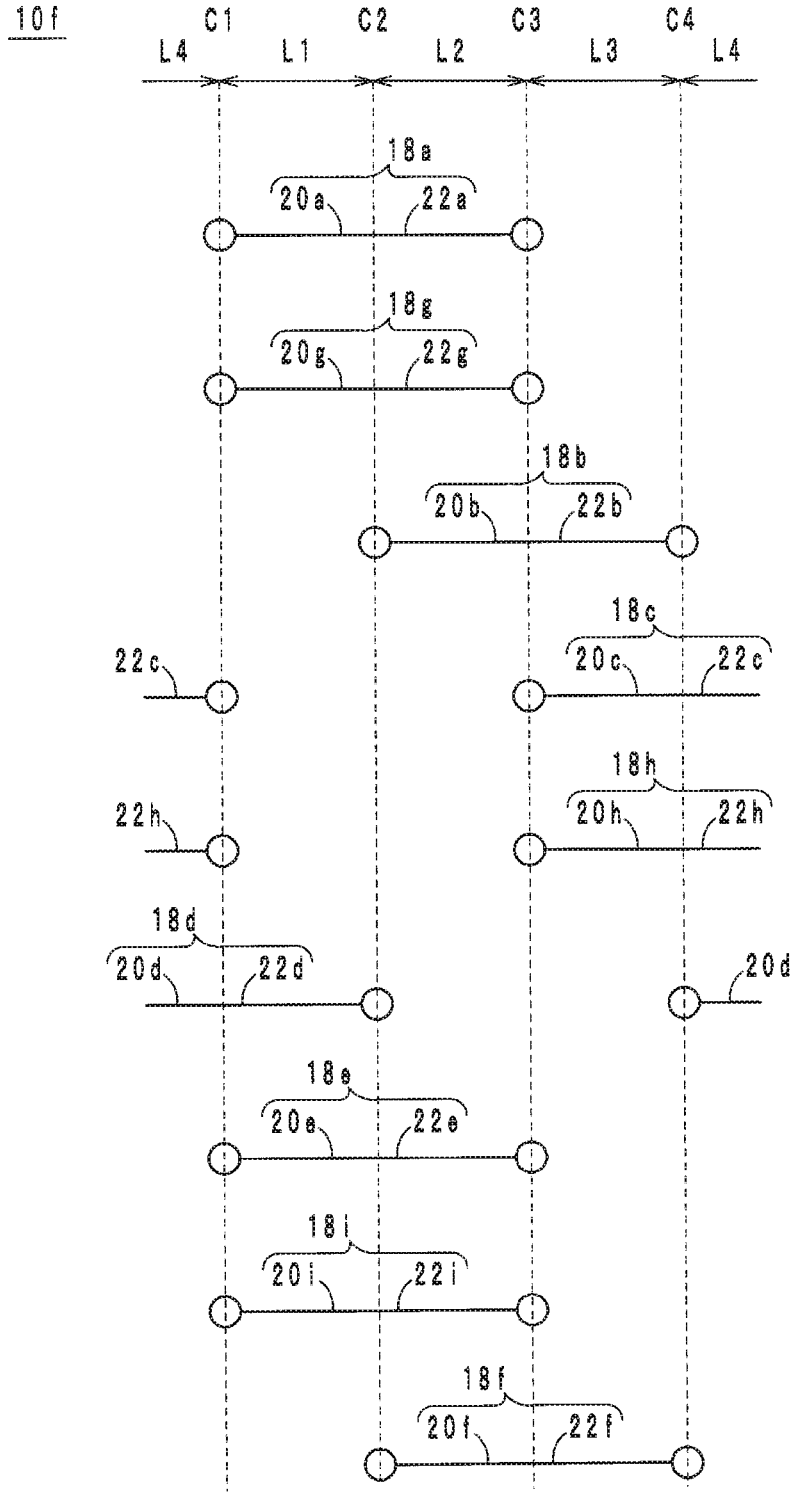
FIG. 19 is a diagram showing the positional relationship between coil conductor layers in the electronic component according to the sixth modified example.
Figure 20:
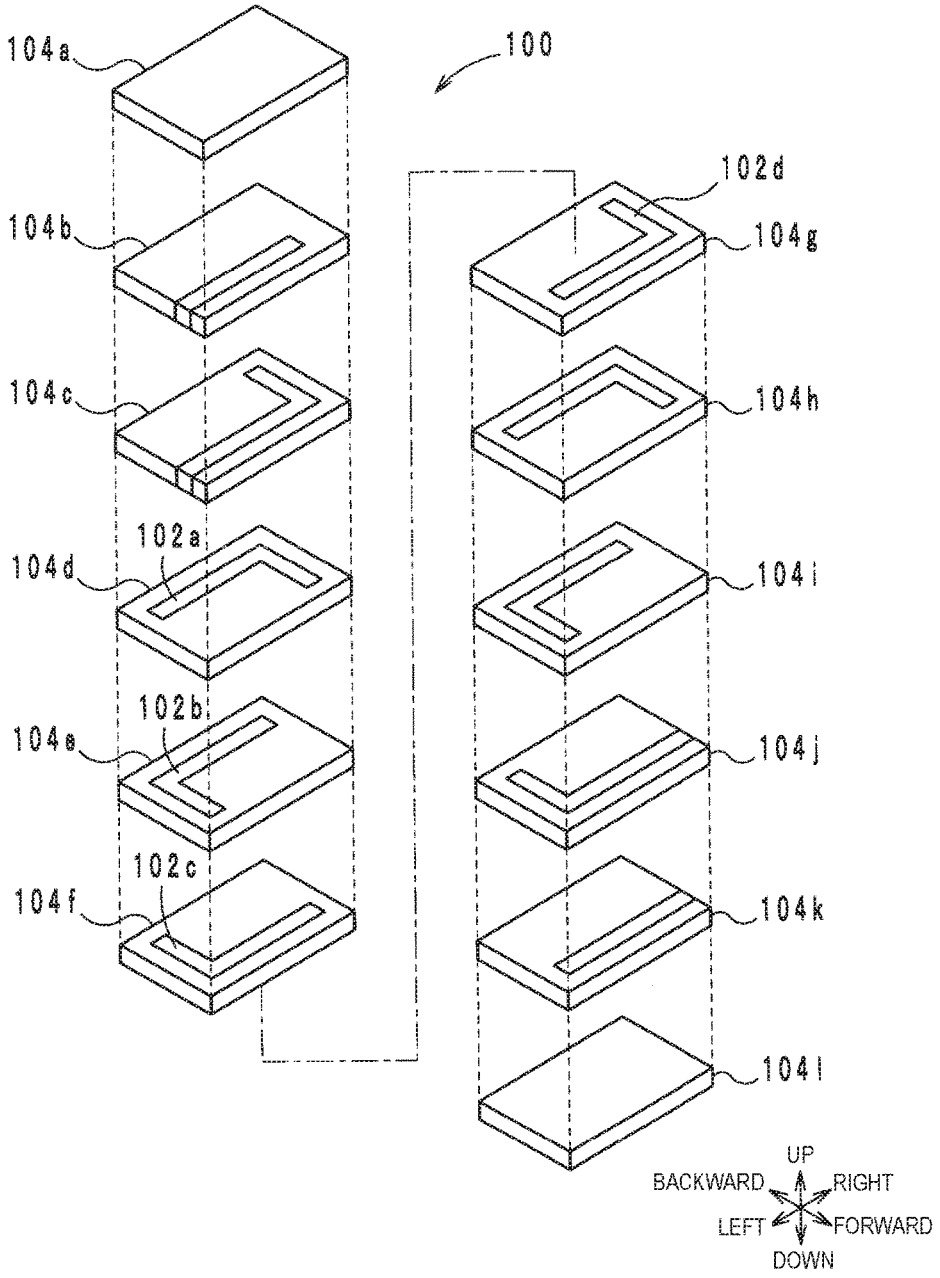
FIG. 20 PRIOR ART
FIG. 20 is an exploded perspective view of a multilayer body of a multilayer electronic component described in Japanese Unexamined Patent Application Publication No. 2010-183007.

An electronic component according to a sixth modified example will be described below with reference to the drawings. FIG. 18 is an exploded perspective view of a multilayer body 12 of an electronic component 10*f* according to a sixth modified example. FIG. 19 is a diagram showing the positional relationship between the coil conductor layers 18*a* to 18*i* in the electronic component 10*f* according to the sixth modified example. An outside perspective view of the electronic component 10*f* is referred to FIG. 1.

The electronic component 10*f* is different from the electronic component 10 in that insulator layers 16*i* to 16*k* and coil conductor layers 18*g* to 18*i* are further included. The electronic component 10*f* will be described below centering on the different points.

The insulator layers 16*a* to 16*h* of the electronic component 10*f* are the same as the insulator layers 16*a* to 16*h* of the electronic component 10 and, therefore, explanations thereof will not be provided.

The insulator layer 16*i* is stacked between the insulator layer 16*b* and the insulator layer 16*c*. The structure of the insulator layer 16*i* is the same as the structure of the insulator layer 16*b*. However, in the insulator layer 16*i*, the lead conductor layer 24*a* is not disposed and a magnetic portion 30*i* is disposed in the portion corresponding to the lead conductor layer 24*a*. The insulator layer 16*j* is stacked between the insulator layer 16*d* and the insulator layer 16*e*. The structure of the insulator layer 16*j* is the same as the structure of the insulator layer 16*d*. The insulator layer 16*k* is stacked between the insulator layer 16*f* and the insulator layer 16*g*. The structure of the insulator layer 16*k* is the same as the structure of the insulator layer 16*f*.

The coil L includes the coil conductor layers 18*a*, 18*g*, 18*b*, 18*c*, 18*h*, 18*d*, 18*e*, 18*i*, and 18*f* arranged in that order from top to bottom. The coil conductor layers 18*a* to 18*f* of the electronic component 10*f* are the same as the coil conductor layers 18*a* to 18*f* of the electronic component 10 and, therefore, explanations thereof will not be provided.

As shown in FIG. 18 and FIG. 19, the coil conductor layer 18*g* (an example of the second coil conductor layer) lies astride the sides L1 and L2 and has the shape of substantially the letter L, when viewed from above. The coil conductor layer 18*g* is disposed in the insulator layer 16*i* so as to penetrate the insulator layer 16*i* in the vertical direction. That is, the thickness of the coil conductor layer 18*g* is substantially equal to the thickness of the insulator layer 16*i*. Consequently, the coil conductor layer 18*g* having the shape of substantially the letter L is exposed when the insulator layer 16*i* is viewed from above and when the insulator layer 16*i* is viewed from below.

The coil conductor layer 18*g* is disposed in a portion excluding the corner C1 of the side L1 and a portion excluding the vicinity of the right end of the side L2. Therefore, as shown in FIG. 18 and FIG. 19, the coil conductor layer 18*g* is not disposed at the corners C1 and C3. Hereafter in the coil conductor layer 18*g*, a portion overlapping the side L1 is referred to as a portion 20*g* and in the coil conductor layer 18*g*, a portion overlapping the side L2 is referred to as a portion 22*g*. As shown in FIG. 18, the portion 22*g* (that is, the coil conductor layer 18*g*) is disposed in the portion excluding the vicinity of the right end of the side L2 and, therefore, is not in contact with the corner C3. That is, a nonmagnetic portion 32*i* is present between the right end of the portion 22*g* and the corner C3. The coil conductor layer 18*g* constitutes the track R by being combined with the nonmagnetic portion 32*i*, when viewed from above. The portions 20*g* and 22*g* of the coil conductor layer 18*g* are connected to the portions 20*a* and 22*a* (coil conductor layer 18*a*). In addition, the portion 22*g* of the coil conductor layer 18*g* is connected to the portion 20*b* (coil conductor layer 18*b* (an example of the third coil conductor layer)).

The portion 20*c* of the coil conductor layer 18*c* (an example of the fourth coil conductor layer) is connected to the coil conductor layer 18*b*.

As shown in FIG. 18 and FIG. 19, the coil conductor layer 18*h* (an example of the fifth coil conductor layer) lies astride the sides L3 and L4 and has the shape of substantially the letter L, when viewed from above. The coil conductor layer 18*h* is disposed in the insulator layer 16*j* so as to penetrate the insulator layer 16*j* in the vertical direction. That is, the thickness of the coil conductor layer 18*h* is substantially equal to the thickness of the insulator layer 16*j*. Consequently, the coil conductor layer 18*h* having the shape of substantially the letter L is exposed when the insulator layer 16*j* is viewed from above and when the insulator layer 16*j* is viewed from below.

The coil conductor layer 18*h* is disposed in a portion excluding the corner C3 of the side L3 and a portion excluding the vicinity of the left end of the side L4. Therefore, as shown in FIG. 18 and FIG. 19, the coil conductor layer 18*h* is not disposed at the corners C1 and C3. Hereafter in the coil conductor layer 18*h*, a portion overlapping the side L3 is referred to as a portion 20*h* and in the coil conductor layer 18*h*, a portion overlapping the side L4 is referred to as a portion 22*h*. As shown in FIG. 18, the portion 22*h* (that is, the coil conductor layer 18*h*) is disposed in the portion excluding the vicinity of the left end of the side L4 and, therefore, is not in contact with the corner C1. That is, a nonmagnetic portion 32*j* is present between the left end of the portion 22*h* and the corner C1. The coil conductor layer 18*h* constitutes the track R by being combined with the nonmagnetic portion 32*j*, when viewed from above. The portions 20*h* and 22*h* of the coil conductor layer 18*h* are connected to the portions 20*c* and 22*c* (coil conductor layer 18*c*). In addition, the portion 22*h* of the coil conductor layer 18*h* is connected to the portion 20*d* (coil conductor layer 18*d*).

The portion 22*d* of the coil conductor layer 18*d* is connected to the coil conductor layer 18*e*.

As shown in FIG. 18 and FIG. 19, the coil conductor layer 18*i* lies astride the sides L1 and L2 and has the shape of substantially the letter L, when viewed from above. The coil conductor layer 18*i* is disposed in the insulator layer 16*k* so as to penetrate the insulator layer 16*k* in the vertical direction. That is, the thickness of the coil conductor layer 18*i* is substantially equal to the thickness of the insulator layer 16*k*. Consequently, the coil conductor layer 18*i* having the shape of substantially the letter L is exposed when the insulator layer 16*k* is viewed from above and when the insulator layer 16*k* is viewed from below.

The coil conductor layer 18*i* is disposed in a portion excluding the corner C1 of the side L1 and a portion excluding the vicinity of the right end of the side L2. Therefore, as shown in FIG. 18 and FIG. 19, the coil conductor layer 18*i* is not disposed at the corners C1 and C3. Hereafter in the coil conductor layer 18*i*, a portion overlapping the side L1 is referred to as a portion 20*i* and in the coil conductor layer 18*i*, a portion overlapping the side L2 is referred to as a portion 22*i*. As shown in FIG. 18, the portion 22*i* (that is, the coil conductor layer 18*i*) is disposed in the portion excluding the vicinity of the right end of the side L2 and, therefore, is not in contact with the corner C3. That is, a nonmagnetic portion 32*k* is present between the right end of the portion 22*i* and the corner C3. The coil conductor layer 18*i* constitutes the track R by being combined with the nonmagnetic portion 32*k*, when viewed from above. The portions 20*i* and 22*i* of the coil conductor layer 18*i* are connected to the portions 20*e* and 22*e* (coil conductor layer 18*e*). In addition, the portion 22*i* of the coil conductor layer 18*i* is connected to the portion 20*f* (coil conductor layer 18*f*).

The above-described electronic component 10*f* can have the same operations and advantages as those of the electronic component 10.

In the electronic component 10*f*, the coil conductor layers 18*a* and 18*g* having the same shape are connected to each other. The coil conductor layers 18*c* and 18*h* having the same shape are connected to each other. The coil conductor layers 18*e* and 18*i* having the same shape are connected to each other. Consequently, the direct current resistance value of the coil L is reduced.

Other Embodiments

The electronic component according to embodiments of the present disclosure is not limited to the electronic components 10 and 10*a* to 10*f* and can be modified within the scope of the gist thereof.

The configurations of the electronic components 10 and 10*a* to 10*f* may be combined appropriately.

In the electronic components 10 and 10*a* to 10*f*, the entirety of the multilayer body 12 may be produced from magnetic materials.

In the electronic component 10, at least three coil conductor layers have to be disposed. This is because, for example, in the case where three coil conductor layers 18*a* to 18*c* are disposed, the coil conductor layer 18*a* and the coil conductor layer 18*c* can be opposed to each other with one insulator layer interposed therebetween at the corner C1, as shown in FIG. 4A.

As described above, the present disclosure is useful for electronic components and, in particular, is excellent in the point that an occurrence of short-circuit in the coil can be suppressed.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An electronic component comprising:

a multilayer body having a configuration, in which a plurality of insulator layers are stacked in the stacking direction; and a coil which is disposed in the multilayer body and which includes a first coil conductor layer, a second coil conductor layer, and a third coil conductor layer arranged in that order from one side of the stacking direction toward the other side, wherein a first side, a second side, a third side, and a fourth side are connected in that order in a predetermined direction so as to demarcate a tetragonal track, when viewed from the stacking direction, the first coil conductor layer lies astride the first side and the second side, the second coil conductor layer lies astride the second side and the third side and is connected to the first coil conductor layer on the second side, the third coil conductor layer lies astride the third side and the fourth side and is connected to the second coil conductor layer on the third side, and at least one of the first coil conductor layer and the third coil conductor layer is not disposed at a first corner formed by the first side and the fourth side, when viewed from the stacking direction.

2. The electronic component according to claim 1, wherein the first coil conductor layer and the third coil conductor layer are not disposed at the first corner, when viewed from the stacking direction.

3. The electronic component according to claim 1, wherein the track has a rectangular shape, the first side and the third side are short sides and the second side and the fourth side are long sides, and the first coil conductor layer is not in contact with the third corner formed by the second side and the third side.

4. The electronic component according to claim 1, wherein the coil further includes a fourth coil conductor layer, the first coil conductor layer to the fourth coil conductor layer are arranged in that order from one side of the stacking direction toward the other side, the fourth coil conductor layer lies astride the fourth side and the first side and is connected to the third coil conductor layer on the fourth side, and at least one of the second coil conductor layer and the fourth coil conductor layer is not disposed at a second corner formed by the first side and the second side, when viewed from the stacking direction.

5. The electronic component according to claim 4, wherein the coil further includes a fifth coil conductor layer, the first coil conductor layer to the fifth coil conductor layer are arranged in that order from one side of the stacking direction toward the other side, the fifth coil conductor layer lies astride the first side and the second side and is connected to the fourth coil conductor layer on the first side, and at least one of the third coil conductor layer and the fifth coil conductor layer is not disposed at a third corner formed by the second side and the third side, when viewed from the stacking direction.

6. The electronic component according to claim 5, wherein the coil further includes a sixth coil conductor layer, the first coil conductor layer to the sixth coil conductor layer are arranged in that order from one side of the stacking direction toward the other side, the sixth coil conductor layer lies astride the second side and the third side and is connected to the fifth coil conductor layer on the second side, and at least one of the fourth coil conductor layer and the sixth coil conductor layer is not disposed at a fourth corner formed by the third side and the fourth side, when viewed from the stacking direction.

* * * * *